US005471231A

United States Patent [19]

Hiraishi et al.

[11] Patent Number: 5,471,231

[45] Date of Patent: Nov. 28, 1995

[54] INK JET HEAD

[75] Inventors: Hisato Hiraishi, Tokyo; Motonobu Hoshino; Tadashi Mitsuhashi, both of Saitama, all of Japan

[73] Assignee: Citizen Watch Co., Ltd., Tokyo, Japan

[21] Appl. No.: 143,050

[22] Filed: Oct. 29, 1993

[30] Foreign Application Priority Data

Oct. 30, 1992 [JP] Japan ..... 4-314257
Dec. 1, 1992 [JP] Japan ..... 4-343594

[51] Int. Cl.[6] ..... B41J 2/045; B41J 2/055

[52] U.S. Cl. ..... 347/68; 347/94

[58] Field of Search ..... 347/68, 69, 71, 347/94; 310/328, 333, 357–359; B41J 2/045

[56] References Cited

U.S. PATENT DOCUMENTS 4,887,100 12/1989 Michaelis et al. ..... 347/69

FOREIGN PATENT DOCUMENTS 485241 5/1992 European Pat. Off. ..... B41J 2/045

*Primary Examiner*—Benjamin R. Fuller
*Assistant Examiner*—Alrick Bobb
*Attorney, Agent, or Firm*—Wenderoth, Lind & Ponack

[57] ABSTRACT

The present invention is directed to drop-on-demand ink jet heads. An exemplary form of an ink jet head of the present invention includes a plurality of elongated members formed of piezoelectric material, the elongated members being spaced apart from one another so as to define therebetween a plurality of elongated channels, alternating ones of which are adapted to be filled with ink so as to define ink channels. Electrodes are formed in the channels on opposing sides of the elongated members. A channel closing member is mounted to the elongated members to cover portions of the channels, the channel closing member having nozzle holes formed therein in alignment with at least some of the channels. The elongated members are polarized in at least one direction. The elongated members and the electrodes constitute an ink jetting mechanism for selectively jetting ink from the nozzle holes by selectively changing volumes of the ink channels by either expansion mode or shear mode deformation of selected ones of the elongated members, upon application of a drive voltage to selected ones of the electrodes. The channels which are not adapted to contain ink are dummy channels. Such dummy channels can alternatively be provided outwardly of the group of ink channels, rather than in an alternating succession with the ink channels.

19 Claims, 29 Drawing Sheets

INK JET HEAD

BACKGROUND OF THE INVENTION

The present invention relates to a drop-on-demand (hereinafter, abbreviated DOD) type ink jet head.

Among non-impact printers, which have a widely expanding commercial market, the ink jet printer is the one which has the simplest principle of operation and is suitable for color printing. Among such printers, the so-called DOD type ink jet printer, which ejects ink droplets in a dot-formation is currently the most commercially important. Examples of DOD type ink jet printers include a Kaiser type, which is disclosed in Japanese Publication No. 12138/1978, and a thermal jet type, which is disclosed in Japanese Patent Publication No. 59914/1986. However, the Kaiser type printer has the disadvantage that it cannot be easily miniaturized, and the thermal jet type printer has the disadvantage that the ink tends to burn due to the application of intense heat.

So as to simultaneously overcome the above-described disadvantages, Japanese Laid-Open Patent Publication No. 159358/1984 proposes an expansion mode type ink jet head which uses deformation in an expansion mode of strips made of piezoelectric material. Japanese Laid-Open Patent Publication No. 252750/1988 proposes a shear mode type ink jet head which uses deformation in a shear mode of strips made of piezoelectric material.

FIG. 35 is a cross-sectional view illustrating the structure of the ink jet head disclosed in Japanese Laid-Open Patent Publication No. 159358/1984. The strips 352*b*, 352*c*, 352*d* made of piezoelectric material such as PZT (lead zirconate titanate) are fixed in parallel on the supporting plate 1 of the electrically conductive material. The upper parts of the strips are fixed to an insulating lid 3. On a surface of the lid 3 to which the strips are fixed, electrodes 354*bc*, 354*de* are formed in advance. The channels formed between each of the strips include, in alternating succession ink filled ink-flowing passage 355*bc*, 355*de* and dummy channels 356*ab*, 356*cd*, 356*ef* which are filled with an elastic material. One end of each ink channel is connected to a common ink reservoir for supplying ink. The other end of each ink channel is covered by a nozzle plate having small holes 10.

The strips made of piezoelectric material are polarized in one direction as shown by arrow 7 (or in the direction opposite thereto). When a negative electric potential is applied to the electrode 354*bc* relative to the electrically conductive supporting plate 1, the strips 352*b*, 352*c* made of piezoelectric material reduce in thickness and the deformation in the expansion mode produces an increase in width. As a result, the cubic volume of the ink channel 355*bc* is reduced, and the pressure of the ink in the ink channel 355*bc* is instantaneously increased so as to cause an ink droplet to be ejected from the nozzle hole 10.

FIG. 36 is a cross-sectional view illustrating the structure of the shear mode type ink jet head of Japanese Laid-Open Patent Publication No. 252750/1988. Barriers 362*a*, 362*b*, 362*c* are formed by forming grooves in a plate made of piezoelectric material. The upper ends of these barriers are adhered to a lid 3 by an elastic material 360. The resulting channels include alternating ink channels 365*bc*, 365*de* and dummy channels 366*ab*, 366*cd* similar to the expansion mode type ink jet head. A common ink reservoir and holes 10 are also provided.

The piezoelectric plate 1 and the barriers are polarized as illustrated by arrows 7. Electrodes 364*ab*, 364*bc*, 364*cd* are formed on the inner wall of each channel.

When a negative electric potential is applied to the electrodes 364*bc*, 364*ab*, as illustrated in FIG. 36, the barrier 362*b* is deformed in the shear mode by interaction between an electrical field shown by the lines 16 of electric force produced by the electric potential and the polarization 7. If negative electric potential is applied to the electrodes of the barriers, the volume of the ink channel 365*bc* is reduced instantaneously from an initial state (such as that shown for the ink channel 365*de*) and the ink droplet is ejected from the nozzle hole 10.

SUMMARY OF THE INVENTION

The present invention has as its objects to obviate the following defects of conventional ink jet heads having thin strips made of piezoelectric material, and to improve the ejection of the ink:

(A) in the expansion mode type of operation, the ink ejecting power is low because the extent of deformation of the slender barriers 352*b*, 352*c*, 352*d* is small;

(B) in the shear mode type of operation, when the ink channel 365*bc* is driven, the neighboring ink channel 365*de* is influenced, such that the ink ejecting power varies;

(C) as the polarization condition of the barrier varies gradually depending on the applied voltage, the ink ejecting power is varied after long use; and (D) as an elastic material 360 is used, the dependability of the connection between the barriers and the lid is low.

The ink ejecting power will now be described in more detail. The sizes of a typical ink jet head, such as that disclosed in Japanese Laid-Open Publication No. 159358/1984 illustrated in FIG. 35, are as follows. The width and height of the slender barriers 352*b*, 352*c*, 352*d*, 352*e* are 50 μm. The length of the ink channels 355*bc*, 355*de* is 10 μm. As the constant of the piezoelectric material and the driving voltage are not disclosed in the patent, we shall assume that piezoelectric constant is $$d_{33}=5\times10^{-10}\ \text{m/v}$$

and the driving voltage is 150 V. These values are larger than in reality. The reduction in volume of the ink channels is estimated to be 60 pl. However, generally,, the diameter of the ink droplet ejected from the ink jet is 20 to 90 μm as disclosed in Japanese Patent Laid-Open Publication No. 1580/1988. Therefore, the droplet volume is 40 μm, i.e. about 30 pl. This is nearly one half of the above estimate of the volume variation.

The energy efficiency of the ink jet head is insufficient even though the ink droplet volume is 30 pl, because the ink flows into the common ink reservoir. Such lack of ink ejecting power causes irregularity in the directions in which the ink droplets ejected, produces deviations in the print dot positions and misprinting of the dot because the highly viscous ink cannot be ejected near the nozzle hole. This misprinting of the printed dot is a major defect of the printer.

The ink ejection power can be improved in the following ways: (1) by raising the driving voltage; (2) by increasing the height of the slender barriers; and (3) by widening the slender barriers.

Because, in practice, 150 V is a very high driving voltage, option (1) cannot be used. Option (2) cannot be used because the driving voltage has to be increased as the height is increased. Also, especially in option (1), the pressure resistance of the piezoelectric material is near to its limit. In option (3), if the same driving voltage is used, the ink ejecting power is increased slightly, but, the pitch between the nozzles is increased because the pitch between the ink channels is increased. This creates a new problem in that the ink jet head is unsuitable for high-resolution printing. In the shear mode type of operation, it is especially important to obviate defect (B) when considering defects (B) and (C).

The interference in this case is about 20% in terms of the variation of the ink ejecting speed. This causes a serious reduction in print quality with respect to dot deviation. The mechanism that causes this interference is not clear, but it is believed to be caused by mutual action between deformation of the root of the plate 361 by the lines of electric force 16*a* passing through the side of the root and the deformation in the shear mode of the barriers 362*c*, 362*d*, etc. In the case of defect (C) above, the polarizing of the piezoelectric material produces polarization in the direction of the lines of electrical force by the impressing of a strong electrical field upon the material. Therefore, in the driving state, it is important to maintain the polarized condition for an extended period of time, when the lines of electrical force 16 and the direction of polarization in the barrier cross at right angles as illustrated in FIG. 36. Particularly when the ink jet head is driven by a relatively high voltage in order to increase the ink ejecting power, this problem becomes more acute.

The defect (D) above needs no explanation.

The present invention is intended to provide an ink jet head which does not have the following problems which commonly occur with conventional ink jet heads using piezoelectric materials. Namely, as the ink channel is long and narrow, fluid resistance cannot be avoided. As most of the pressure in the channel is lost, the ink ejecting power is reduced. The lost pressure ultimately changes to heat energy. If the pitch between the nozzles is reduced to obtain high-density and high-quality print, the fluid pressure is rapidly increased. Therefore, this problem becomes more acute. If sections of the channels are analogous, the increase is roughly in inverse proportion to the fourth power of the increase of the pitch.

As described above, the present invention is intended to resolve the problems present in the conventional ink jet head using a piezoelectric material, namely, the lack of ink ejecting power and uniformity of the ejection of ink, by increasing the ink ejecting power. The invention is intended to provide an ink jet head capable of providing high-quality print over an extended period, without blocking of the nozzles.

Conventional ink jet heads have the following additional defects, which will be described by way of example of the shear mode type shown in FIGS. 37–40, which has a structure similar to that of type shown in FIG. 36.

When a sufficiently large positive electric potential is applied to the electrodes 394*a*2 and 394*b*1, the barriers 395*ab* deforms in a shear mode as shown in FIG. 40. As flexibility of the elastic material 399 is higher than that of the adhesive layer 398, deformation of the barrier 395*ab* appears as a displacement relative to the lid 3. Similarly, when a large positive electric potential is applied to the barrier 395*bc* (normally electrodes 394*b*1 and 394*b*2 are of the same electric potential), the sectional area of the groove 392*b* forming the ink chamber and ink channel is reduced (see FIG. 40) from its initial condition (see FIG. 39). If ink is present in the groove, the pressure of the ink rises suddenly and an ink droplet is ejected from the nozzle hole 10*b* as a result of the reduction in sectional area of the groove.

FIG. 37 shows a shear mode type head having 6 nozzles which operates on the same basic principle as that shown in FIG. 39. It consists of an insulating plate 1, grooves 372*a*–372*f*, nozzle holes 10*a*–10*f*, barriers 375*ab*–375*ef* made of piezoelectric material, electrodes 374*a*2–374*f*1 and a lid 3. The head has an adhesive layer 378, an elastic material 379, and a polarization direction 7 of the barriers 378. If the distance between the grooves is very small, the head can be miniaturized in the manner similar to a thermal jet type head. It problems caused by high temperatures in a Kaiser type head do not occur.

FIG. 41 is a perspective view of an ink jet head constructed as described above and disclosed in Japanese Laid-Open Publication No. 252750/1988.

The head shown in FIG. 41 includes an insulating plate 1, a groove 412 forming an ink chamber and an ink channel, barriers 415 made of piezoelectric material, and a nozzle plate 8 having nozzle holes 10. An ink droplet is shown at 11, an ink supply hole is shown at 12, and a common ink reservoir is shown at 13. Driving of the head will now be described with reference to FIG. 37. The four grooves 373*b*–372*e* may eject ink droplets as shown in FIG. 39, but the ink ejected from the two outermost grooves 372*a* and 372*f* depends on the deformation of only one barrier 375*ab* or 375*ef*. If the deformation of the barriers 375*ab* or 375*ef* is equal to that of the other barrier 375*bc* or 375*de*, the actual ejecting power of the outermost grooves is small, such that the volume of the ink droplet and ink ejection speed are smaller. In an extreme case, the ink cannot be ejected. This causes uneven dot size and dislocation of the dots, and therefore results in remarkably poor printing quality.

Such lowering of the ejecting power may be prevented by applying a different driving voltage at the center than at the ends. In FIG. 38, straight lines 387, 388 and 389 depict zero voltages. The vertical axis depicts voltage and the horizontal axis depicts time. In this case, signals of opposite phase are applied to facing barriers as described in connection with FIG. 39. As the barriers have to move suddenly when ejecting ink and slowly on return to their original positions, the wave is non-symmetric. It is important that only the barrier 375*ab* has applied thereto a voltage wave 382 of twice the absolute value of the waves 381, 383, 384, 385, 386. By applying such a wave, it is possible to prevent a decrease in the ink ejecting power at the two ends. But, this causes new problems to occur, as follows:

(1) as the extent of deformation of the barrier 385*ab* by the voltage wave 382 is large, the pressure in the next groove 382 is reduced considerably, and air bubbles are generated in the ink of the groove 382*b*. This may prevent ejection of the ink;

(2) as the barrier 385*ab* is deformed to a large extent by the voltage wave 382, the extent of deformation to the side of the groove 382*b* by reaction of the barrier after having the voltage has been applied, and this deformation causes the wrong ink to be ejected from the nozzle 10*b*; and (3) as the voltages 381 and 382 are not symmetrical and the absolute value of the voltage 382 is large, a new polarization is often produced in the direction of the electrodes 384*b*1 to 384*a*2 in the barrier 385*ab*, thereby causing a lower driving power of the barrier 385*ab*.

The present invention is intended to solve the ununiformity of ink ejection of the conventional print heads and the instability of ink ejection which occurs when it is attempted to avoid such ununiformity.

The present invention provides an ink jet head which produces a high quality print.

Furthermore, conventional ink jet heads have the following defects. In the head of FIG. 41, the nozzle plate 8 is to the side of the insulating plate 1 adhered to shut the slender grooves 412 forming the ink chamber and the ink channel. However, the barrier 415 of piezoelectric material may be damaged on the end portion of the side of the nozzle plate before being adhered to the nozzle plate, because the piezoelectric material is a brittle ceramic material such as PZT and the width of the barriers 415 is very thin, for example, less than 100 μm, and can be easily broken by shock. Such damage to the barriers occur at the portion where it is to be adhered to the nozzle plate. If a part of the barrier is broken, the ink will flow into the adjacent groove, such that the ink ejecting pressure close to the nozzle hole which is important for ejecting the ink will become unstable due to interference between the grooves, and the ink ejection will become non-uniform.

The present invention is intended to improve the non-uniformity of the ink ejection of the conventional ink jet heads, which occurs because the material is brittle.

Embodiment 1-1

Figure 1:
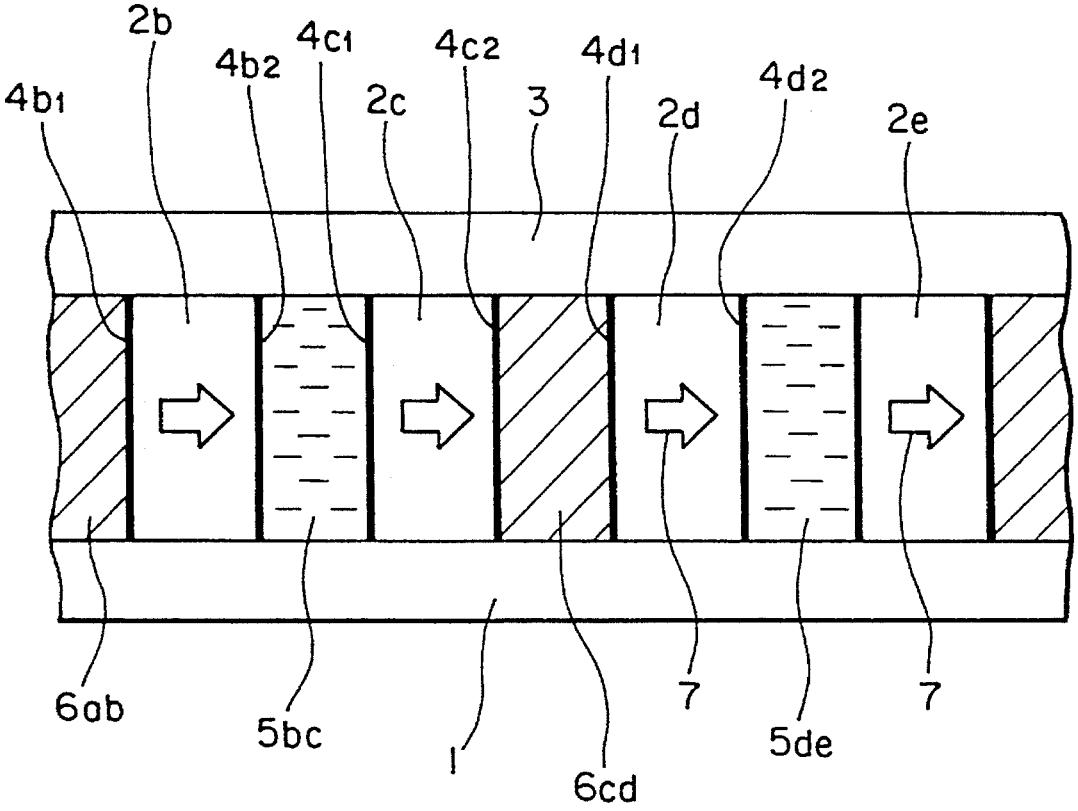
FIG. 1 is a sectional view of Embodiment 1-1 of the ink jet head of the present invention.
Figure 35:
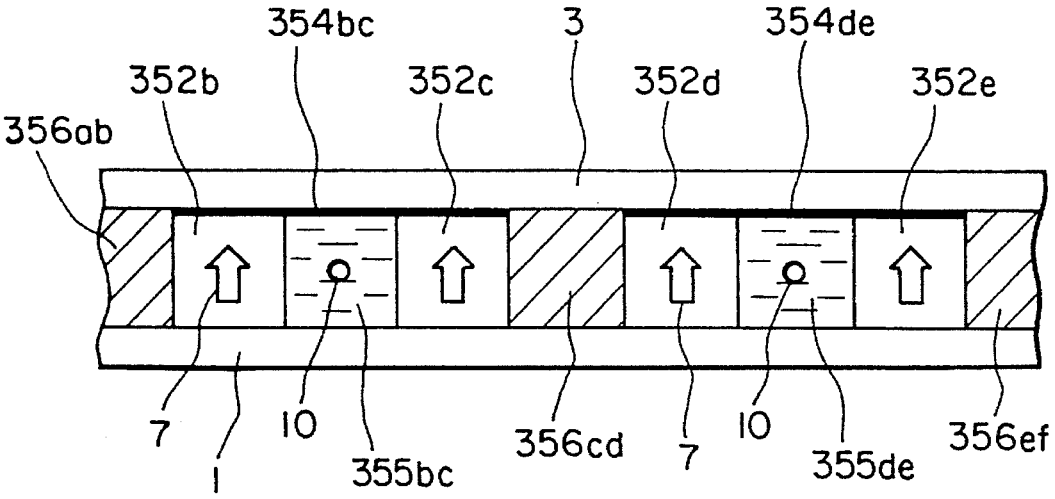
FIG. 35 PRIOR ART
FIG. 35 is a sectional view of a conventional expansion mode type ink jet head.

FIG. 1 shows an ink jet head of the present invention which is similar to the conventional ink jet head of FIG. 35. Barriers 2*b*, 2*c*, 2*d*, 2*e* made of piezoelectric material are fixed on an insulating support plate 1. The upper faces of such barriers are fixed to an insulating lid 3.

The differences between this ink jet head and the conventional head of FIG. 35 are (i) the support plate has insulating properties, (ii) the electrodes are formed on the sides of the barriers, and (iii) the direction of polarization is across the barriers, as shown by the arrow 7. It is not necessary for the directions of all the polarizations to be the same.

Ink channel 5*bc*, 5*de* and dummy channels 6*ab*, 6*cd* are arranged in alternating succession. The dummy channels 6*ab*, 6*cd* are filled with an elastic material, as in the conventional ink jet head.

Figure 2:
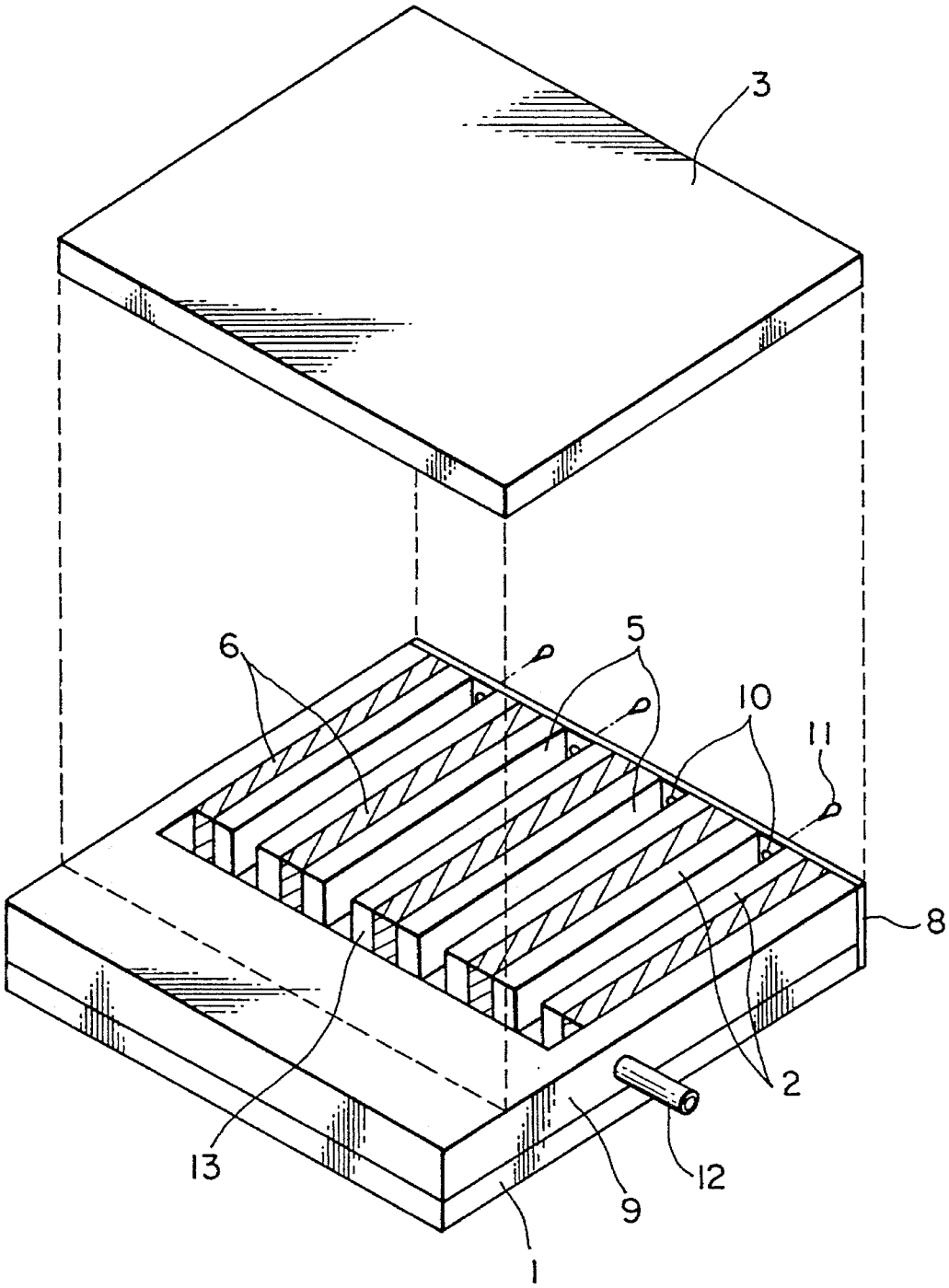
FIG. 2 is a perspective view of Embodiment 1-1.

FIG. 2 is a schematic view of the ink jet head of this embodiment. This ink jet head consists of the ink channels 5 and dummy channels 6 in alternating succession and separated by the barriers 2 which are made of piezoelectric material and are fixed to the insulating support plate 1 in parallel to one another. The dummy channels 6 are filled with the elastic material, and the ends of the barriers are adhered to a nozzle plate (or channel closing member) 8 to close the ends of the channels. All of the channels are covered with the lid 3. A spacer 9 is also provided to form the ink flow channels.

Nozzle holes 10 are formed in the nozzle plate 8 at the ends of the ink channels 5, and the ink droplets 11 are ejected from the nozzle holes 10. The ink is supplied to the ink channels 5 via a common ink reservoir from an ink inlet 12.

Electric connections are omitted to simplify the drawing.

The support plate 1 and the lid 3 are formed of alumina and are 0.8 mm thick. The barriers formed of PZT are 50 μm in width and 200 μm in height. The ink channel 5 is 50 μm in width and 10 mm in length. Electrodes 4 are formed by laminated membranes which are 0.8 μm in width and are filled with chromium and gold. The dummy channels 6 are 50 μm in width and are filled with silicone rubber.

The nozzle plate 8 is made of stainless steel, and the nozzle holes formed therein are 35 μm in diameter. Fifty nozzle holes are formed in a line with a pitch of 200 μm.

Figure 3:
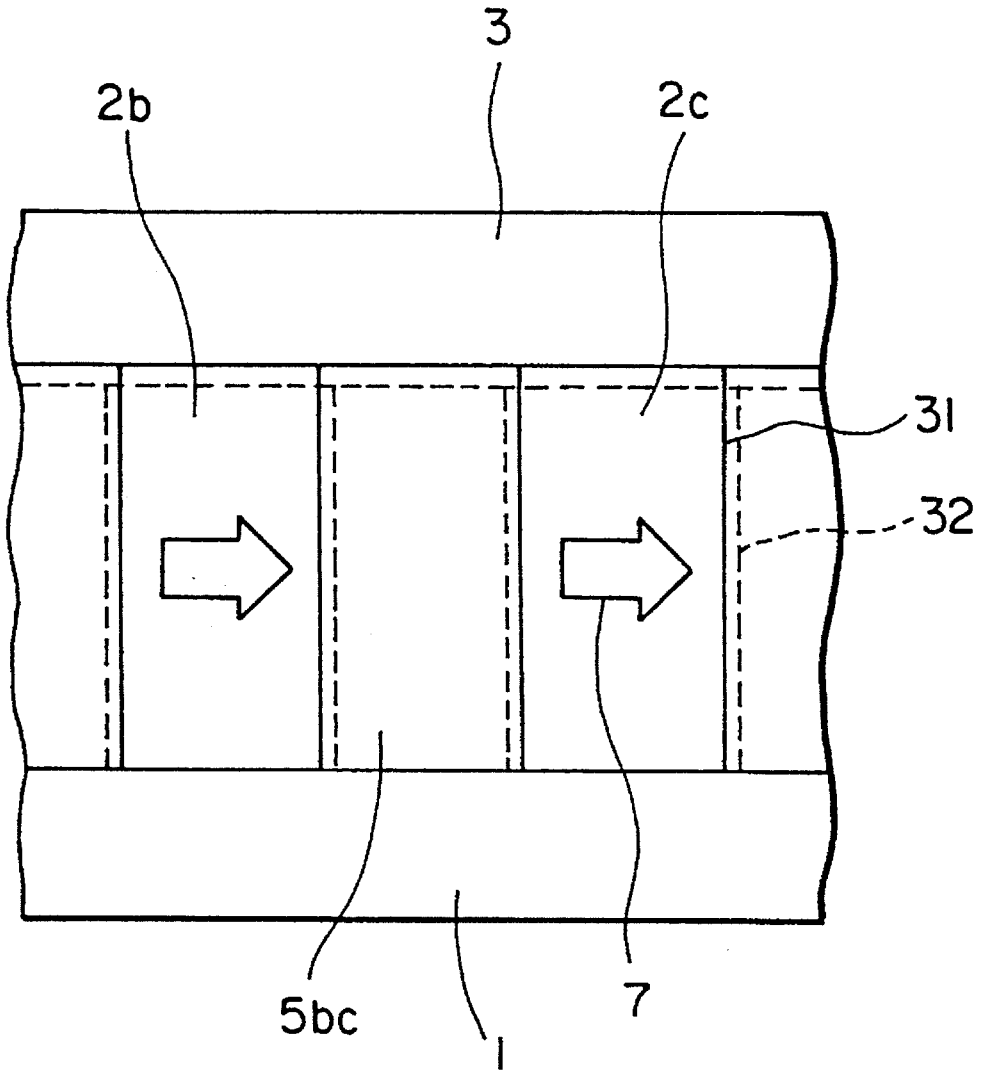
FIG. 3 is a sectional view for describing a driving principle.

FIG. 3 illustrates the operating principle of the print head, and shows a left portion of FIG. 1 on an enlarged scale. The electrodes **4*b*1 and 4*b*2 are omitted to simplify the drawing. The solid line 31 shows a shape before a voltage is applied to the electrodes, and the dash line 32 shows a shape after the voltage has been applied to the electrodes. A positive voltage is applied to each left electrode and a negative voltage is applied to each right electrode. Electrical fields having a direction as shown by arrow 7 are formed in each of the barriers 2*b*, 2*c*. As a result, the deformation in the expansion mode occurs, causing a lengthening in the direction of the arrow 7 and a shrinking in the vertical direction. This deformation is shown by the dash line 32. The ink channel 5*bc* is accordingly reduced in volume because of the deformation, and the ink droplets are ejected from the nozzle holes as with the conventional ink jet head of FIG. 35**.

Thus, in this embodiment shown in FIGS. 1–3, the barrier 2, ink channels 5 and dummy channels 6 of FIG. 1 are the same in width as those of FIG. 35, but have heights of 200 μm, or four times the heights in the conventional head of FIG. 35. When a voltage of 150 V is applied to the barriers having the same piezoelectric constant as in the conventional head, the volume reduction of the ink channel is proportional to the height and is thus about four times 150 pl.

Thus, a larger drive power can be obtained given the same conditions as for the conventional head of FIG. 35, to thereby achieve considerable improvement in the ink ejecting power. The height of the barrier may be selected as occasion demands, so long as the structural strength is maintained. As the print head of this example may achieve the large volume reduction as described above, a considerably reduced driving voltage may be used. This reduction of the driving voltage is useful in practice.

Embodiment 1-2

Figure 4:
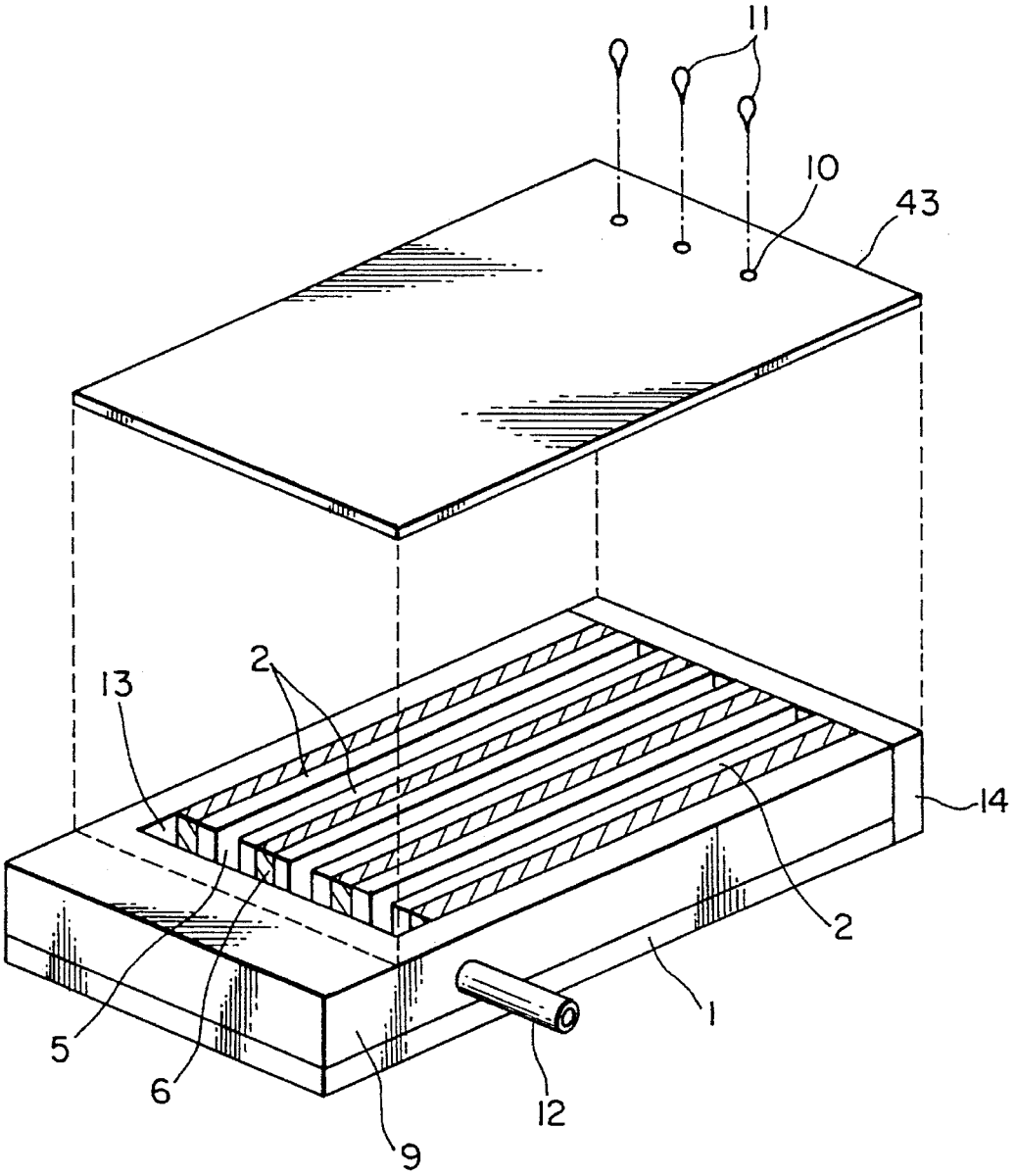
FIG. 4 is a perspective view of Embodiment 1-2 of the present invention.

The embodiment shown in FIG. 4 is different from the embodiment shown in FIG. 2 with respect to the structure of the ink ejecting part. The ink channels 5 and dummy channels 6, filled with elastic material, are formed in alternating succession on the insulating support plate 1. Ink is supplied to the ink channels 5 via the common ink reservoir 13 from the ink inlet 12.

The distinctive features of this embodiment are that the nozzle plate 8 of FIG. 2 is replaced by an ink sealing plate 14, and the lid 3 of FIG. 2 is replaced by a lid (or a channel closing member) 43 having nozzle holes 10. The nozzle holes 10 are formed above the ink channels 5 and the ink droplets 11 may be ejected from the nozzle holes 10. However, the ejecting direction differs by 90° from the embodiment of FIG. 2.

The barriers 2 are easily damaged at their end portions because of the brittleness of the material from which they are made. Thus, in the FIG. 2 embodiment there is the possibility of failure in that adjacent channels will connect with one another near the nozzle plate 8. However, in the embodiment of FIG. 4, the sealing plate is fixed by good adhesion, such that damage may be prevented.

Embodiment 1-3

Figure 5:
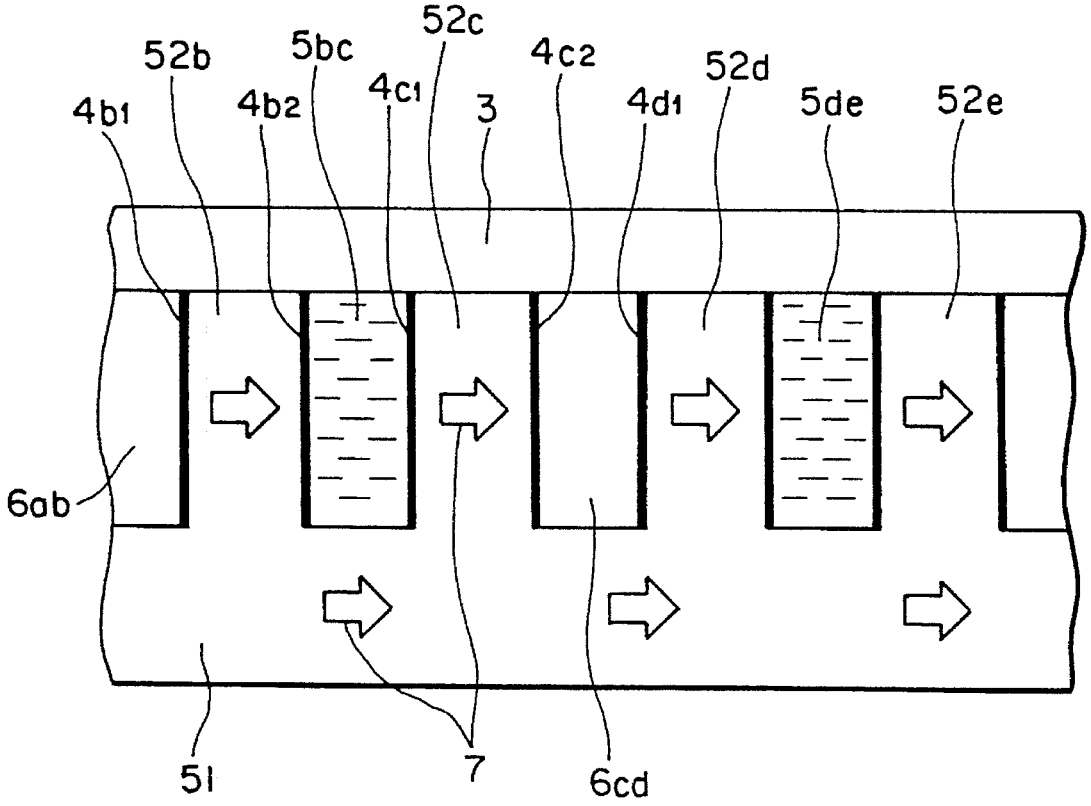
FIG. 5 is a sectional view of Embodiment 1-3 of the present invention.

FIG. 5 is a cross-sectional view showing an embodiment which differs from the previous embodiment in the manner in which the channels are formed. Otherwise, the structure of this embodiment is the same as that of FIG. 1.

The grooves are formed directly in the piezoelectric base plate 51, thereby forming the barriers **52*b*, 52*c*, 52*d*and 52*e***. Therefore, the barriers are formed in the support plate in a single process. The grooves are formed by a dicing saw or a wire saw.

In this embodiment, the plate 51 is formed of piezoelectric material that is polarized as shown by the arrow 7. Therefore, the part of the head which is an insulating plate in the FIG. 1 embodiment is a polarized piezoelectric body in this embodiment. However, this does not affect the operation of the ink jet head.

The electrodes **4*b*1, 4*b*2, 4*c*1, 4*c*2, etc. are formed on the side walls of the barriers, and the grooves are covered by the lid 3 to form the ink channels 5*bc*, 5*de*, etc. and dummy channels 6*ab*, 6*cd*, etc. The drive and operation are the same as for the FIG. 1 embodiment. The dummy channels 6*ab*, 6*cd***, etc. are filled with elastic material.

Embodiment 1-4

Figure 6:
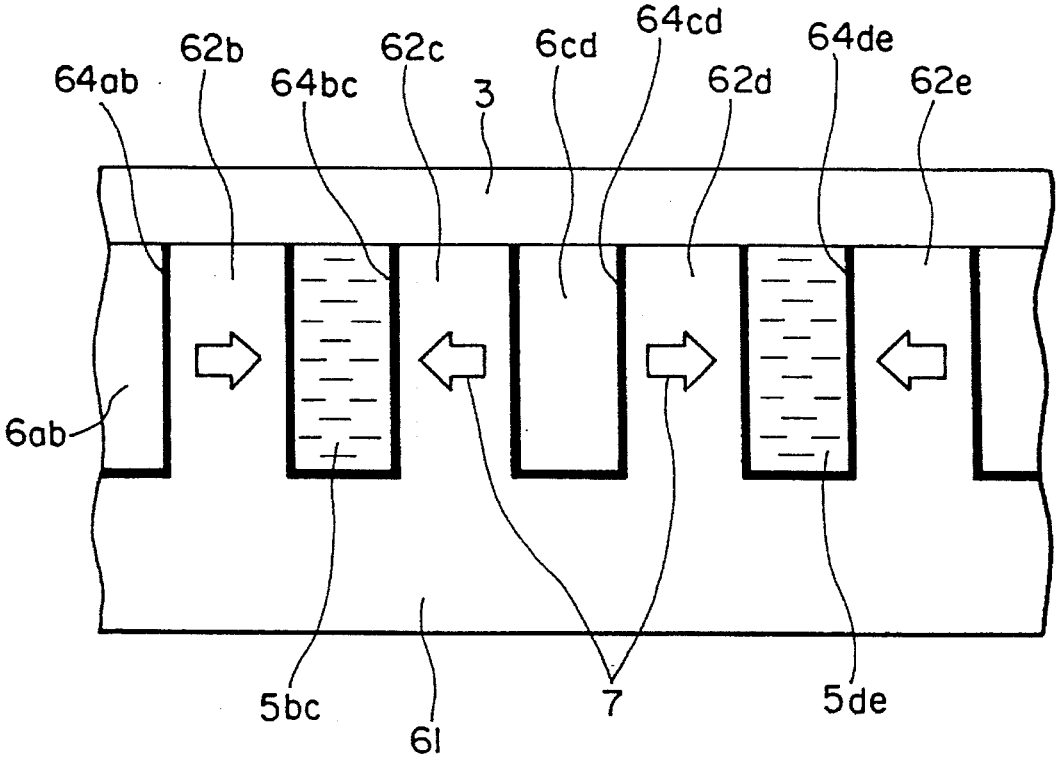
FIG. 6 is a sectional view of Embodiment 1-4 of the present invention.

As shown in FIG. 6, the ink jet head of this embodiment is provided with grooves formed in the piezoelectric material in the same manner as in the embodiment of FIG. 5. In this embodiment, the piezoelectric plate 61, at the time of forming the grooves, is still not polarized. The resulting barriers **62*b*, 62*c*, etc. are polarized, by using the electrodes 64*ab*, 64*bc*, 64*cd*, etc. which are formed in the grooves, in the directions shown by the arrows 7. As shown by the arrows 7, the polarizations of neighboring barriers are directed in opposite directions. The reason for this is to improve the ink ejecting power by fixing all of the dummy channels 6*ab*, 6*cd*, etc. at common ground electric potential and by applying a single-pole drive electric pulse (a positive pulse in the case of FIG. 6**) to the ink channels for ejecting the ink.

The electrodes **64*ab*, 64*bc*, 64*cd*, 64*de*** are formed on all surfaces of the grooves so as to obtain the same potential on both sides of each barrier. This may contribute to simplifying the construction because the drive is simplified and because the number of the electrodes is reduced by half.

As the dummy channels are present to prevent interference between the ink channels, their size is not limited. It is desirable to form the width of the dummy channels as narrow as possible in order to obtain high-resolution print. The widths of the dummy channels and the ink channels may be different, and it is desirable to make the dummy channels of a narrow width.

When a voltage is applied to the barriers of the piezoelectric material from the side of the channel, as in the present invention, the volume of the ink channel is reduced considerably by increasing the height of the barriers without increasing the drive voltage and by changing distance between channels. As a result, the ink jet head is provided with high ink ejecting pressure and is suitable for high resolution printing.

The structure of this embodiment may also be obtained by using a conventional print head manufacturing process.

The required ink ejecting power may be obtained by changing the height of the barriers made of piezoelectric material to produce the desired ink ejecting power. It is not necessary to increase the drive voltage. By improving of the ink ejecting power, a consistent print quality may be obtained, and blockage of the nozzle holes of the ink jet head does not occur. Therefore, the ink jet head has a high dependability.

Embodiment 2-1

Figure 7:
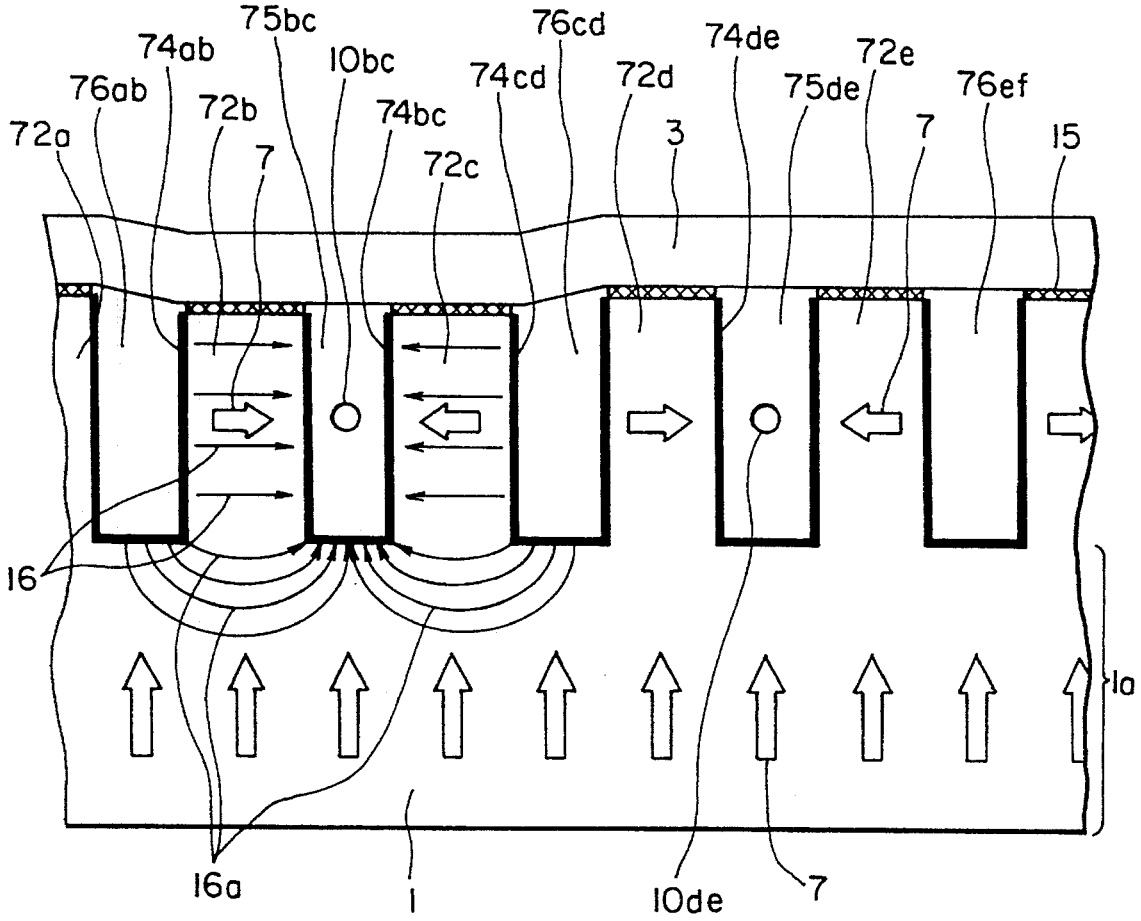
FIG. 7 is a sectional view of Embodiment 2-1 of the present invention.
Figure 36:
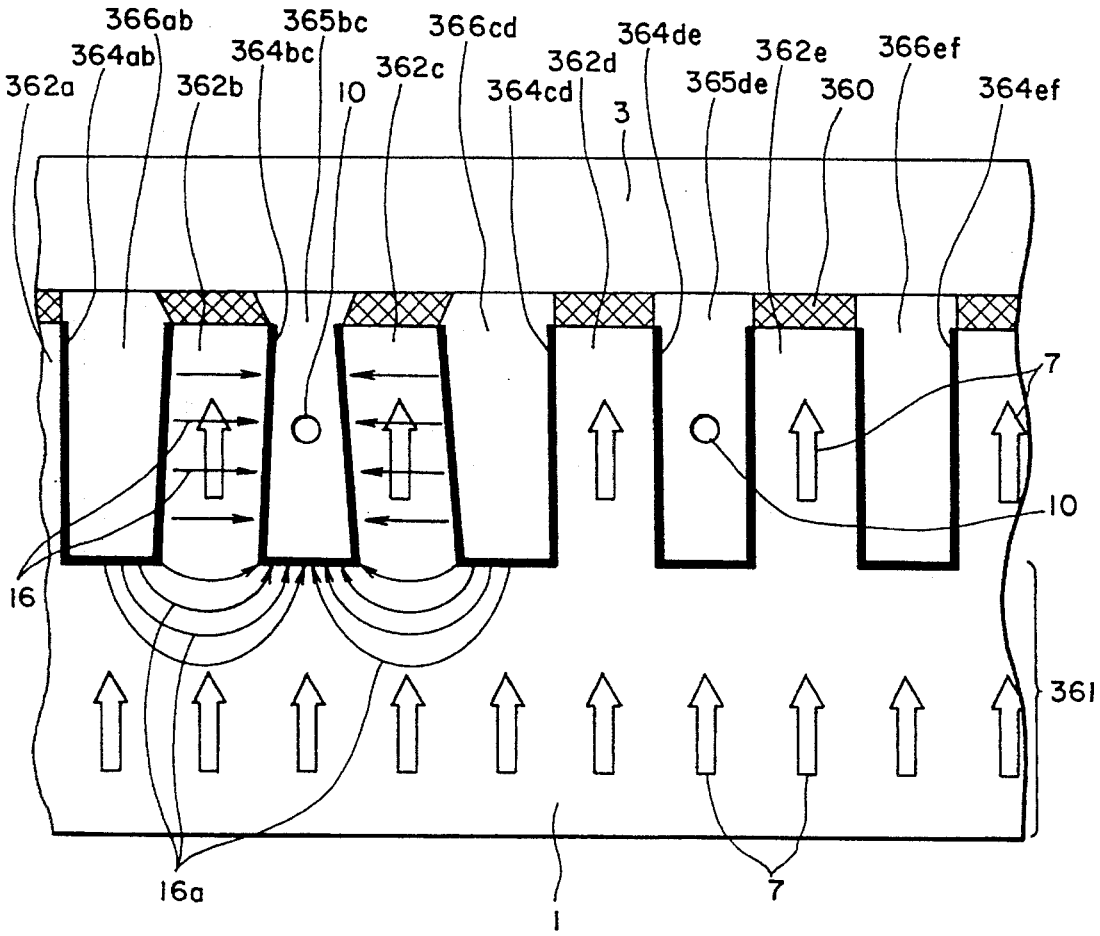
FIG. 36 PRIOR ART
FIG. 36 is a sectional view of a conventional shear mode type ink jet head.

FIG. 7 shows an ink jet head similar to that shown in FIGS. 35 and 36. Barriers 72*a*, 72*b*, 72*c*, etc. are obtained by forming grooves in a plate 1 made of piezoelectric material, and the electrodes 74*ab*, 74*bc*, 74*cd*, etc. are formed on the inner walls of the grooves. An insulating lid 3 is fitted on the barriers by a durable adhesive layer 15 so as to form channels. These channels include ink channels 75*bc*, 75*de*, etc. and dummy channels 76*ab*, 76*cd*, etc. arranged in alternating succession. First ends of the ink channels are connected to the common ink reservoir, and nozzle holes 10*bc*, 10*de*, etc. are formed on the second ends of the ink channels.

This structure is similar to that of FIG. 36.

However, an essential feature of this embodiment is that the polarization in the barriers is in a direction across the walls of the barriers, as shown by the arrows 7. Thus, the directions of the polarizations are toward one another. The polarization of the lower portion 1*a* of the piezoelectric plate 1 is directed as shown by the arrows 7. The relationship of the polarization direction between the barriers and the polarization direction in the lower portion 1*a* is as shown in FIG. 7. However, the directions of polarization can all be opposite to those of the arrows.

The sectional shapes of the ink channels and dummy channels are the same, but, the width of the dummy channels may be reduced, because the dummy channels are used to separate the ink channels. The dummy channels can be empty or can be filled with an elastic material.

Figure 8:
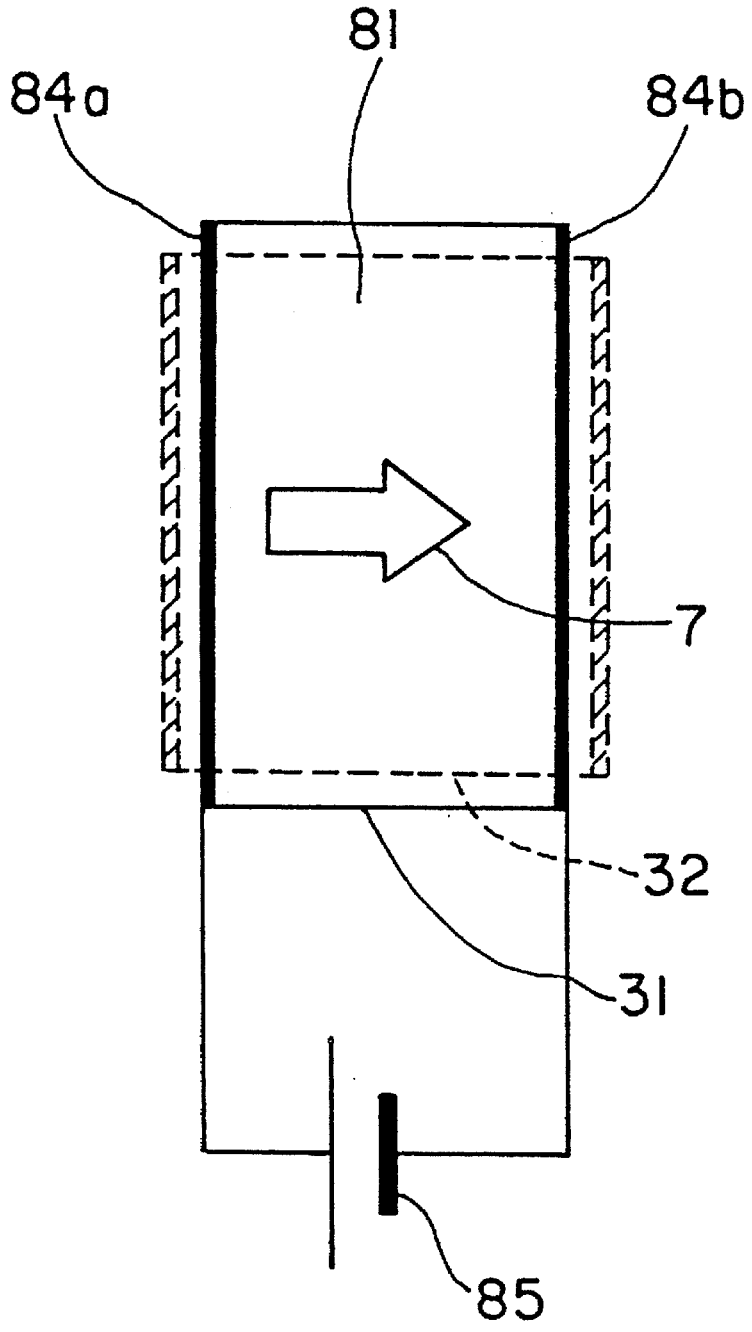
FIG. 8 shows the deformation in an expansion mode of Embodiment 2-1.

FIG. 8 shows an expansion mode deformation of the piezoelectric material. Electrodes 84*a* and 84*b* are formed on the piezoelectric material 81 which is polarized as shown by the arrows 7. The solid line 31 shows the shape when no voltage is applied to the electrodes 84. The dotted line 32 shows the shape when a negative electrical potential is applied to the electrode 84*a* from the current source 85. The expansion mode deformation results in expansion of the barrier along the direction of the electric field and shrinkage in the vertical direction against the electric field. Such deformations constitute the general behavior of piezoelectric materials. The deformation occurs when the direction of the electric field and the direction of polarization nearly coincide.

In FIG. 7, when a negative electric potential, relative to the electrode 74*ab*, is applied to the electrode 74*bc*, the barrier 72*b* undergoes an expansion mode deformation by interaction between the lines of electric power and the polarization. If the same electrical potential is applied to the barrier 72*c*, the width and height of the ink channel 75*bc* will decrease and the sectional area will decrease relative to the ink channel 75*de* in an initial condition. As a result, an ink droplet is ejected from the nozzle hole 10.

However, in the present invention, it is important that the ink ejecting power does not depend on deformation of the barrier only. Thus, deformation in the expansion mode may occur at a lower part of the ink channel 75*bc* of the base plate 1*a* due to interaction between the polarization 7 and the lines of electric force 1. This deformation acts to reduce the width of the channel. The ink ejecting performance depends on both deformation of the barrier and the lower portion of the channel.

Figure 9:
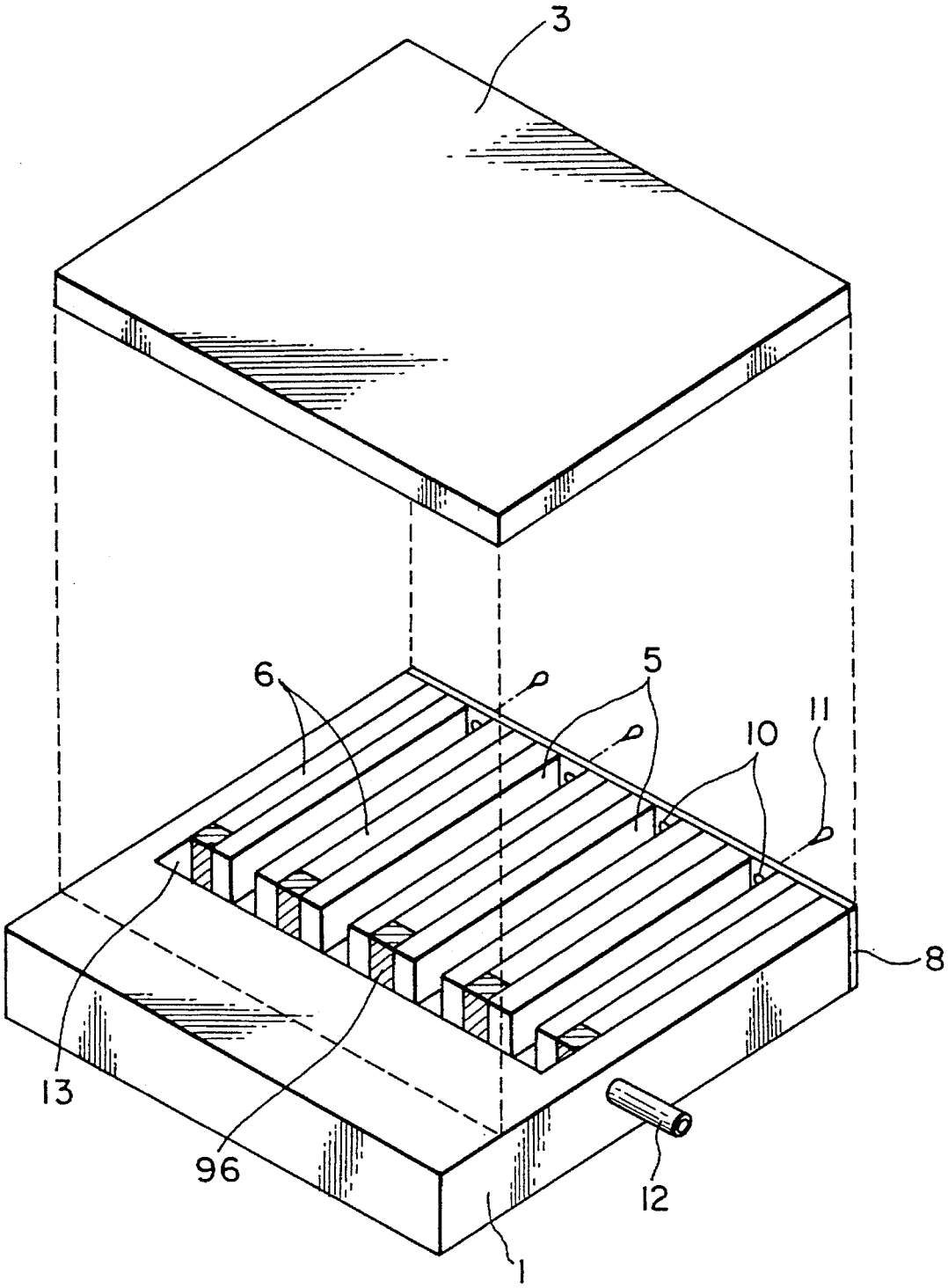
FIG. 9 is a perspective view of Embodiment 2-1.

FIG. 9 is a schematic view of the ink jet head according to this embodiment. In this head, the ink channels 5 and dummy channels 6 are formed in alternating succession by forming grooves in the base plate 1 of piezoelectric material. A nozzle plate 8 is attached at the ends of the grooves to close the grooves. The lid 3 fully covers the grooves. Stoppers 96 are provided to keep the dummy channels void of ink. Nozzle holes 10 are formed in the nozzle plate 8 at the ends of the ink channels 5. The ink droplets are ejected from these nozzle holes 10. The ink is introduced from the ink supplying hole 12 and is provided to the ink channels 5 via the common ink reservoir 13.

The electric connections are omitted to simplify the drawing figure.

Figure 10:
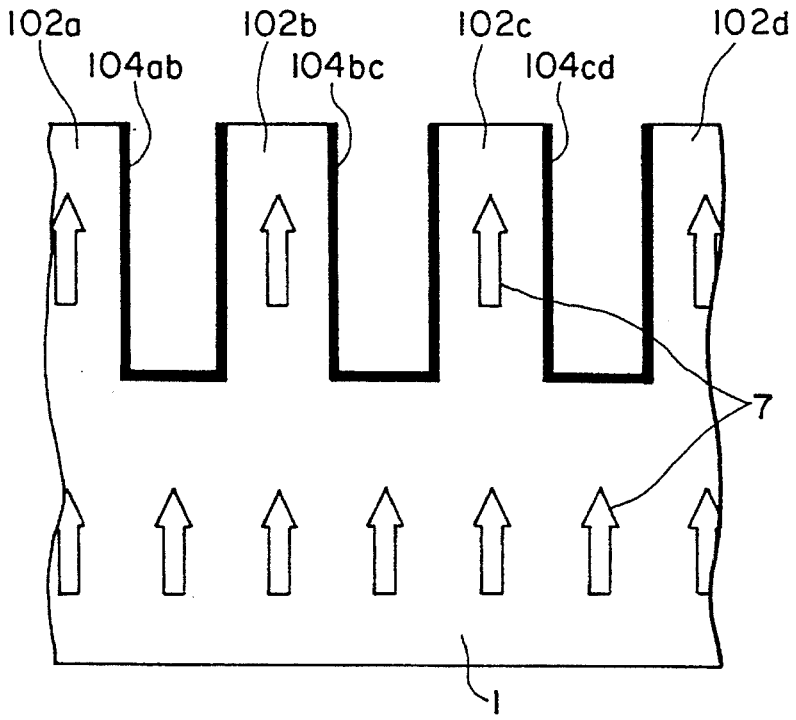
FIGS. 10 and 11 are sectional views for describing a first polarizing process.
Figure 11:
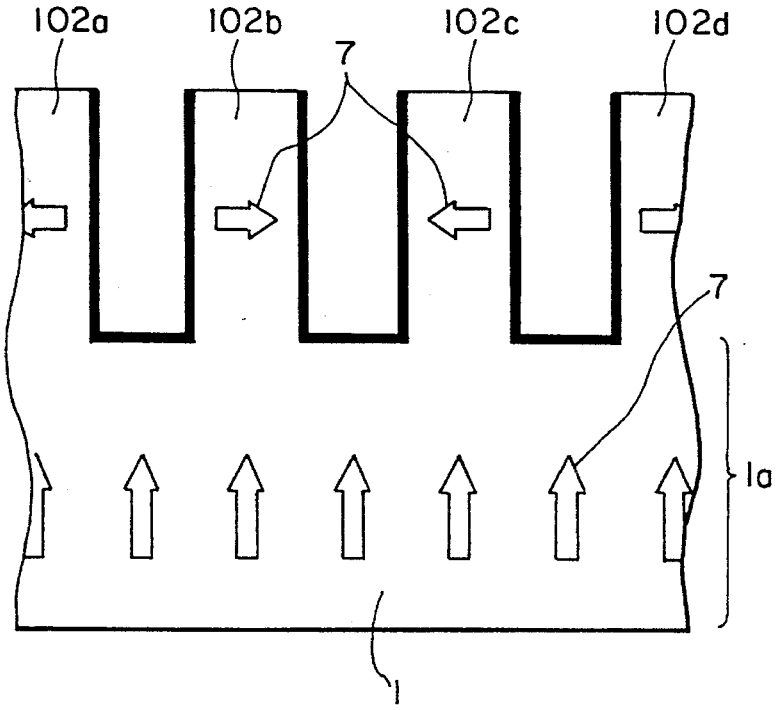

The process of polarizing the piezoelectric base plate of the present head is described with reference to FIG. 10 which is a sectional view. In FIG. 10, the base plate made of piezoelectric material is polarized and grooves and electrodes are formed. At this stage, the embodiment is of the same construction as that shown in FIG. 36 with respect to the base plate 1, the polarization directions 7, the barriers 102*a*, 102*b*, and the electrodes 104*ab*, 104*bc*. Next, a high voltage is applied between adjacent electrodes. By applying this high voltage, the polarization of the barriers is rotated by 90° as shown in FIG. 11. Thus, the basic plate of the present embodiment as shown in FIG. 7 is obtained.

The high voltage for rotating the polarization is an electrical field having the same direction as the polarization, and it is suitably about 1 to 2 V per 1 μm of thickness of the barrier. It is desirable to heat the base plate in silicone oil at about 1000° C. The polarization in the lower portion of the base plate must not be varied by applying a voltage above the voltage mentioned above.

Figure 12:
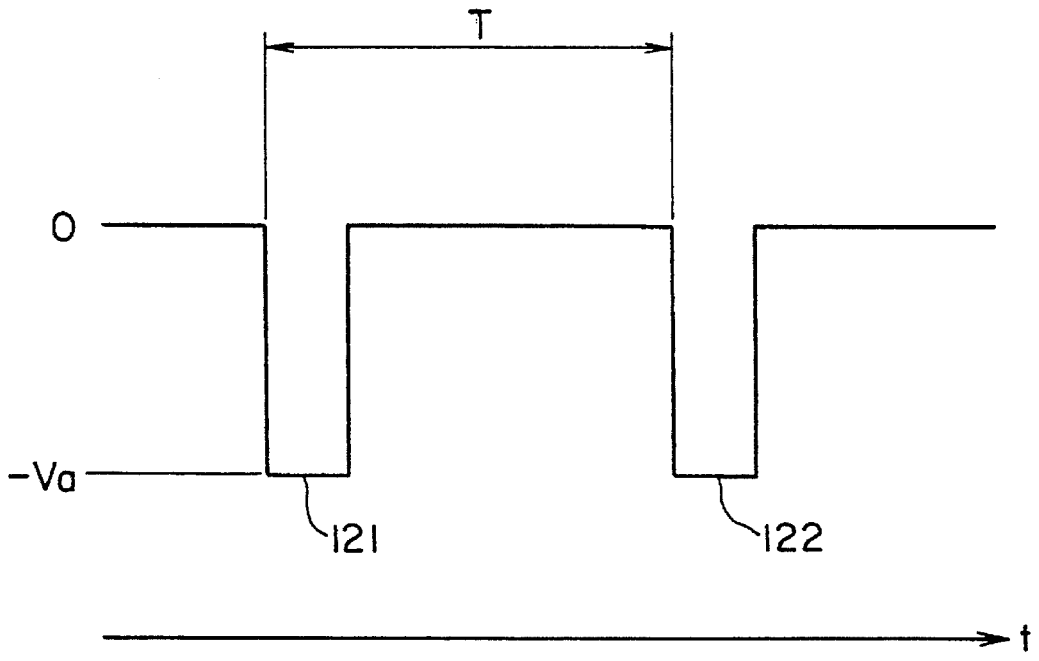
FIG. 12 shows a drive wave form used in Embodiment 2-1.

FIG. 12 shows one example of a drive wave for use with the head according to the present embodiment. In the ink channel 75 of FIG. 7, the electrodes 74*ab*, 74*bc* of both dummy channels 76*ab*, 76*cd* are connected to ground, and an electrical potential having the wave form shown in FIG. 12 is applied to the electrode 74*bc* of the ink channel. The ink droplets are ejected at intervals by applying a negative voltage pulse 121, 122. The period T between adjacent pulses determined the maximum period of the ink jet head.

This head is made as follows. The base plate 1 of PZT having a thickness of 1 mm is polarized in the thickness direction. The polarized plate 1 has grooves formed therein having a width 50 μm, a height of 200 μm and a pitch of 100 μm by means of dicing saw. The length of the grooves is 10 μm.

Electrodes are formed on the side walls and bottom surfaces of the grooves. The electrodes are formed by deposition of laminated films of chromium and gold having a thickness of 0.8 μm.

By using the electrodes, the polarization direction in the PZT barriers is rotated by 90° in the manner as described in connection with FIG. 10. A plastic lid 3 having a thickness of 6 mm, and a stainless steel nozzle plate having nozzle holes with a diameter of 30 μm, are firmly bonded by an epoxy resin adhesive as in FIG. 9. The entrance at the common ink reservoir sides of the dummy channels are sealed by the silicon resin adhesive.

The effects of the present embodiment will be described by comparison with the convention arrangement of FIG. 35. The width of the ink channels is 50 μm. However, the depth is different in that, in the present embodiment, it is 200 μm and in FIG. 35 it is 50 μm. If the present embodiment is the same as the conventional arrangement with respect to the piezoelectric material and the voltage applied, the volume reduction of the ink channels by deformation of the barriers becomes about 150 pl, i.e. four times in proportion to the depth reduction. This volume of the ejected ink drop is large in comparison with that ejected by the standard head.

The combined expansion mode ejection, as in the present invention, may produce a large ink ejecting power in cooperation with the deformation of the bottom of the ink channel. The present invention may attain a greatly improved ink ejecting power even when the drive voltage is the same as in the conventional case.

The depth of the ink channel may be changed, so long as it does not give rise to structural problems. Therefore, the most suitable structure may be chosen. As an ink jet head having a structure according to the present invention may undergo a large volume reduction, it is possible to significantly decrease the drive voltage. Therefore, it has many advantages in practice.

In order to explain the effects of the present embodiment, it will now be compared with the conventional case shown in FIG. 36. In the conventional ink jet head, an important problem is the interference which arises when adjacent ink channels are driven. The degree of such interference is about 20%. In the present embodiment, the ink ejecting power of the ink channel 75*bc* changes by less than about 3% when the adjacent ink channel 75*de* is driven. This does not matter much in practice.

According to the present embodiment, the interference between ink channels, which is very serious problem, does not arise. The mechanism causing this interference is not fully clear, but it believed that the deformation of the bottom 71 of the base plate due to the lines of electric force in the bottom and the polarization 7 and the deformation in the expansion mode of the barriers 72*c* (72*d*) are mutually denied.

For durability test, the pulse of FIG. 12 was applied about $3\times10^9$ times. As a result, it was confirmed that the change in ink ejecting efficiency and the deterioration in adhesion between the barrier and the cover can be avoided. Therefore, the arrangement is not affected by the change in polarization in the barriers and the deterioration of the adhesion layer 15. In FIG. 7, the deformation of the lid 3 adjacent to the ink channel 75*bc* is shown exaggerated. It is actually a very small deformation of about 0.1 μm.

Figure 13:
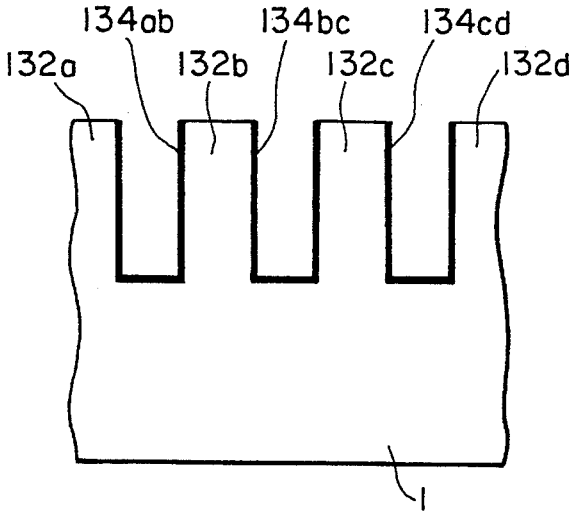
FIGS. 13 to 15 are sectional views for describing a second polarizing process.
Figure 14:
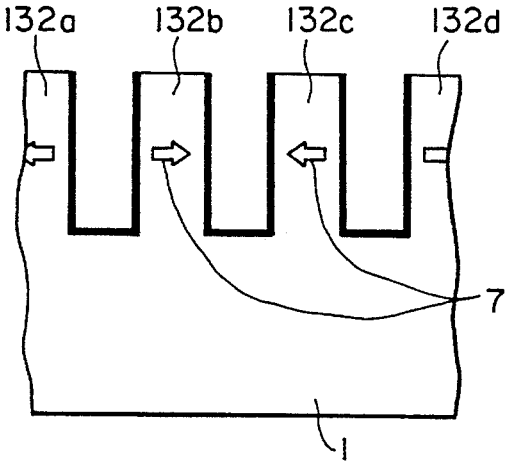

FIG. 13 shows another polarization condition of the piezoelectric base plate of the ink jet head according to the present embodiment. The arrangement shown in FIG. 13 may be obtained by forming grooves in a non-polarized piezoelectric material, and then forming the electrodes. The head includes a base plate 1, barriers 132*a*, 132*b* and electrodes 134*ab*, 134*bc*. High voltage is applied between adjacent electrodes, and the insides of the barriers are polarized as shown by the arrows 7 in FIG. 14. The voltage applying conditions are the same as described with reference to FIG. 10.

Figure 15:
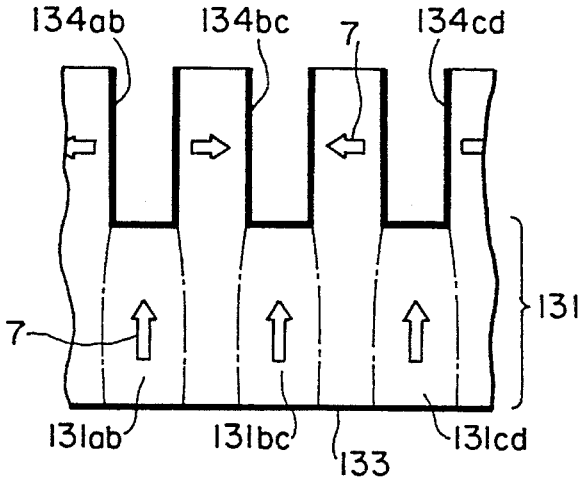

After the application of voltage, a rear electrode 133 is formed on a rear (or bottom) of the base plate 1 and a high voltage is applied between the rear electrode 133 and the electrodes 134*ab*, 134*bc*, 134*cd* disposed in the channels. A bottom portion 131 of the base plate 1 is polarized as shown by the arrows 7. Actually, the bottom portion of the base plate is polarized only in the areas 131*ab*, 131*bc*, 131*cd* depicted by the dotted lines in FIG. 15. The parts of the bottom portion outside the areas 131*ab*, 131*bc*, 131*cd* are scarcely polarized. However, the present embodiment can meet its objective.

The voltage applying conditions for polarization of the base plate are the same as for the barriers. The voltage applied is preferably rather large, such as about 2 to 3 V per 1 μm thickness of PZT. As the voltage application does not effect the barrier, it is polarized to a nearly saturated condition. In this process, the order of the steps shown in FIGS. 14 and 15 may be changed. The rear electrode may be present or omitted.

It is a very important feature of FIG. 13, compared with FIG. 10, that the cover and the barrier are joined by the adhesion layer 15 at high temperature, if they are joined just after the step of FIG. 13. If a temperature in the neighborhood of the Curie temperature is applied to the polarized piezoelectric material, generally, the polarization condition will deteriorate to a large extent. Therefore, if the barrier and the cover are joined when the piezoelectric material is not polarized, the deterioration may be avoided. Even if an organic adhesive that hardens at a temperature over 150° C., a high density adhesive layer may be formed. However, a temperature near this temperature may cause a deterioration in the polarization condition. If the barrier and cover member are joined when the piezoelectric material is not polarized, a non-organic adhesive may be used, such as low melting point glass which has a higher treating temperature than the organic adhesive and a strong adhesive value.

Embodiment 2-2

Figure 16:
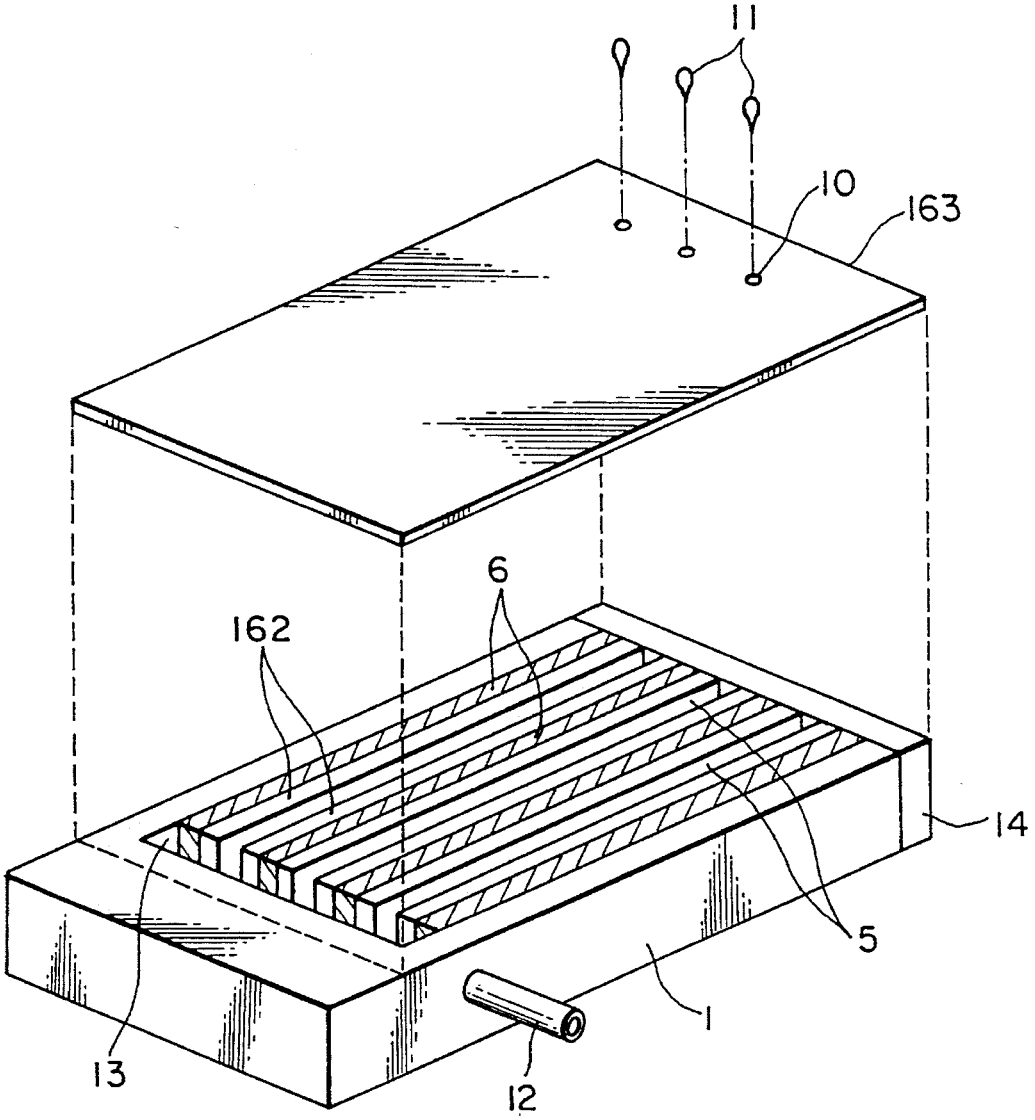
FIG. 16 is a perspective view of Embodiment 2-2 of the present invention.

FIG. 16 is a schematic view of another embodiment of the present invention, similar to that of FIG. 9. On the base plate 1 of the piezoelectric material, ink channels 5 and dummy channels 6 are formed in alternating succession. The ink is supplied to the ink channels 5 through the ink supplying tube 12 and the common ink reservoir 13.

This construction is the same as in FIG. 9, but in this embodiment the dummy channels 6 are filled with the elastic material. Furthermore, the nozzle plate of FIG. 10 is replaced by a sealing plate 14, and the lid for covering the channels is replaced with a cover 163 having nozzle holes 10. The nozzle holes 10 are formed above the ink channels 5. The ink droplets 11 are ejected from the nozzle holes 10. The direction in which the droplets are ejected differs by 90° from that of FIG. 9.

The barriers 162 are brittle, especially at their ends. In the FIG. 9 arrangement, such brittleness can produce failure in that the adjacent channels may mutually connect near the nozzle plate. However, in the present embodiment such defects are avoided, because the sealing plate 14 is fixed by good adhesion.

Embodiment 2-3

Figure 17:
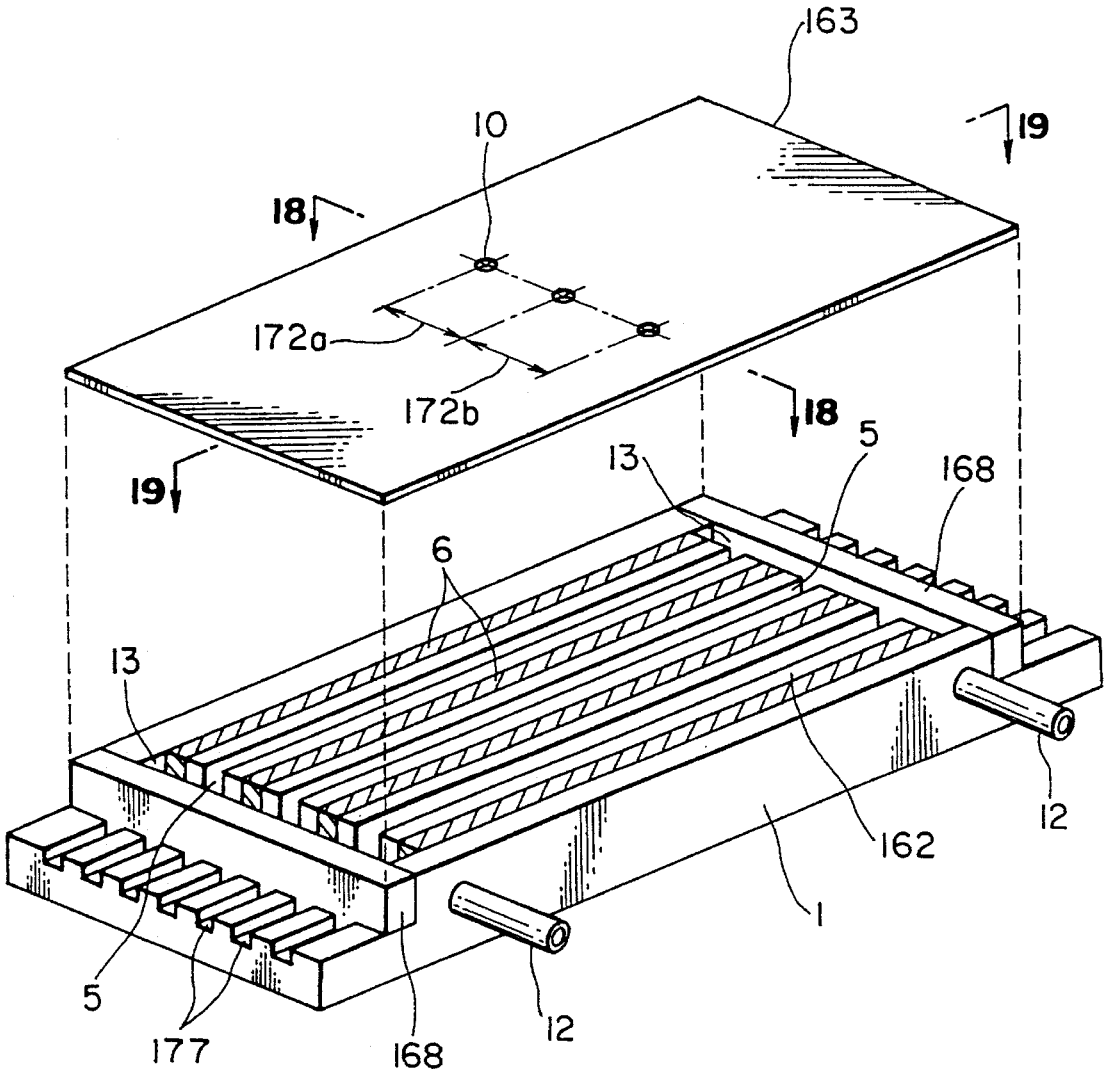
FIG. 17 is a perspective view of Embodiment 2-3 of the present invention.

FIG. 17 shows another embodiment of the present invention. The characteristic features of this embodiment are that the nozzle holes 10 are formed at the center of the longitudinal direction of the lid 163, and a common ink reservoir 13 is provided at both ends of the ink channels. In describing this embodiment, descriptions of parts in common with the FIG. 16 embodiment are omitted.

Shallow grooves 177 are formed at both ends of the ink channels 5 and dummy channels 6 during the step in which the channels 5 and 6 are formed. These shallow grooves 177 are used for connecting with other electrodes. The lid 163 may comprise separate parts; one having nozzle holes and the other acting as a cover. These parts may cover the channels and one of the ink reservoirs, respectively.

Figure 18:
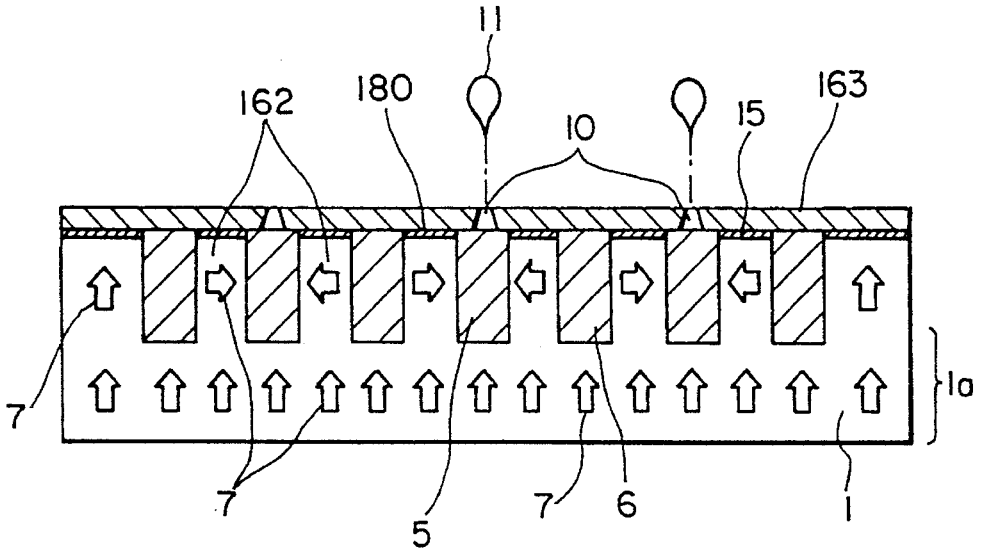
FIGS. 18 and 19 are sectional views of Embodiment 2-3.
Figure 19:
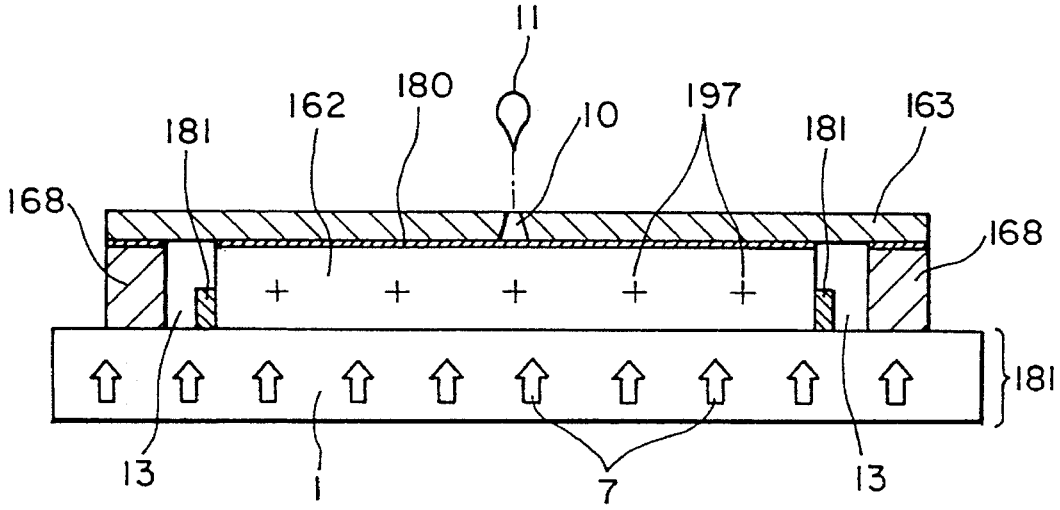

FIGS. 18 and 19 are cross-sectional views taken along lines 18—18 and 19—19 of FIG. 17, respectively. The base plate 1 formed of piezoelectric material is polarized at the barriers 162 and at the bottom portion 1*a* of the plate 1, respectively, as shown by the arrows 7 and the "+" signs 197

(i.e. in the vertical direction of the paper). The cover 163 having nozzle holes 10 is adhered by a hard adhesive layer 15 in order to position the nozzle holes 10 above the centers of the ink channels 5.

Barriers 181 are formed at junctions between the common ink reservoirs 13 and the ink channels 5 for producing fluid resistance. The object is to efficiently use the pressure produced in the channel when ejecting ink droplets. The fluid resistance caused by the barriers 181 is such that they do not prevent the supply of ink from the common ink reservoirs.

The electrodes are not shown.

The ink droplets 11 are ejected at right angles to the surface of the lid 163.

According to the present embodiment, the conventional defect that the ink ejecting power drops as a result of fluid resistance in the ink channels 5 is avoided.

Figure 20:
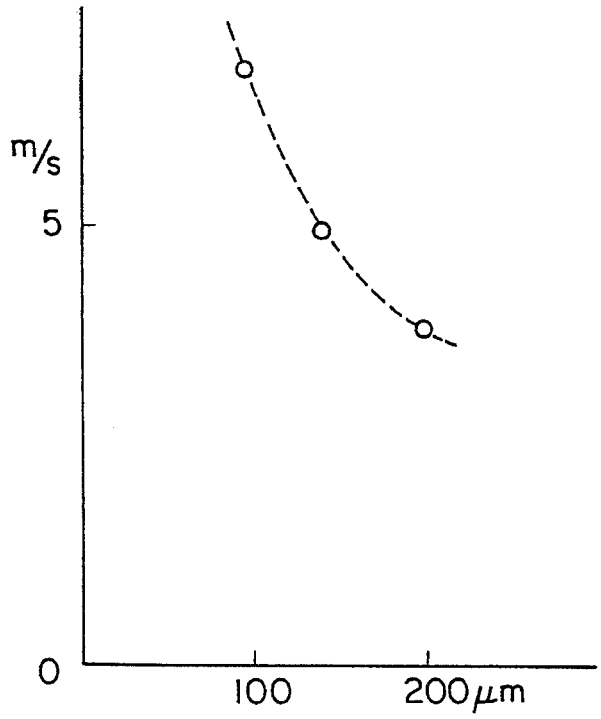
FIG. 20 shows results obtained in use of Embodiment 2-3.

In FIG. 20, the pitch of the ink channel is shown on the transverse axis and the change in ink ejection is shown on the ordinates axis (the ratio of the width and depth of the ink channels and the length thereof are fixed). In this case, the fluid resistance in the ink channels increases in inverse proportion to the fourth power of the pitch. Therefore, the ink ejecting speed drops. Thus, it is presumed that the remarkable deterioration in the ink ejecting speed when the pitch is small is mainly due to the fluid resistance. By using a head having a pitch of 200 μm (the ratio of the width and depth of the groove and the length is the same as the head of FIG. 10), an ink ejecting speed of 5.5 m/s is obtained. It is believed that: (1) As the length of the channel to the nozzle hole from the common ink reservoir is one-half that of the conventional case, the fluid resistance is reduced by half; and (2) As the number of ink channels for each nozzle hole is two, the fluid resistance is further reduced by half. Therefore, the overall fluid resistance is reduced to one quarter.

Embodiment 2-4

Figure 21:
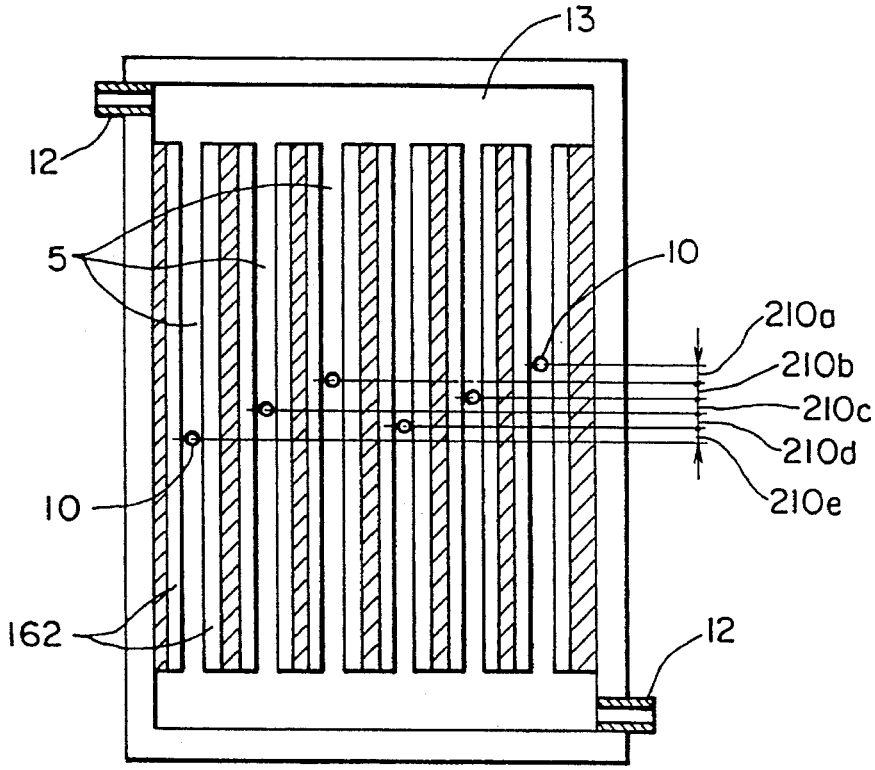
FIG. 21 is a plan view of Embodiment 2-4 of the present invention.

FIG. 21 shows another embodiment, which is similar to that of FIG. 17.

The nozzle holes in the FIG. 17 embodiment are arranged in a straight line, but in the present embodiment, the arrangement is changed. In the FIG. 17 embodiment, the dot pitch for printing is determined by the nozzle hole pitches 172*a*, 172*b* which are arranged at equal intervals. In the FIG. 21, the dot pitch is determined by the pitches 210*a* to 210*e*. Each pitch 210*a* to 210*e* is equivalent. In this case, the sum total of the pitches 210*a* to 210*e* may be less than the length of the ink channels. Therefore, each nozzle hole 10 may be arranged at about the center of the ink channel 5.

The main advantages of this embodiment is that the relationship between the channel pitch and print dot pitch can be determined independently by arranging the nozzles as described above. As a result, the channel pitch may be arranged as desired. This is very useful when making the head.

According to the combined expansion mode embodiments of the present invention, the extent of deformation during expansion of the barrier and the reduction in volume of the ink channels may be increased by raising the height of the barriers without changing the intervals between the adjacent ink channels and without increasing the drive voltage. The volume of the ink channels can be further reduced by leakage of the electrical field to the bottom of the base plate. This further volume reduction by leakage of the electric field may be confirmed in the case of the conventional shear mode type head. However, in the shear mode type head, the interference as described above cannot be avoided.

As a main feature of the present invention, such interference may be virtually avoided. As direction of the electric field at the barrier is the same as the direction of the polarization, a long-term change of the polarization, as in a conventional head, does not occur. It is unnecessary to use an elastic material for fixing the lid of the base. Therefore, long-term dependability may be obtained. As a result, ink jet heads can be provided which have large ink ejecting power and a dependability suitable for high-resolution printing.

This construction may be produced by a manufacturing process similar to that for producing a conventional head. In this center nozzle type of construction, as the ink is supplied from both ends of the ink channels, the influence of the fluid resistance in the ink channel may be largely decreased. It is decreased by half because of the length of the channels and by another half due to the effective number of the ink channels compared with the conventional case. Overall, the resistance is one quarter that of the conventional case.

As the decrease in the ink droplet ejecting power due to the fluid resistance to the nozzle hole may be considerably lessened, an ink jet head having a fine ink ejecting performance is obtained.

Accordingly, the combined expansion mode type ink jet head of the present invention is greatly improved in ink ejecting power, interference between channels, and dependability, relative to an ink jet head for which the piezoelectric strip is driven in the expansion mode or the shear mode. The ink jet head may provide high quality and uniform print without irregularities and has a long-term dependability. This ink jet head may efficiently improve the decrease in the ink ejecting power due to the fluid resistance of the ink channels, which is a serious problem in ink jet heads which are driven by using piezoelectric strips.

Embodiment 3-1

Figure 22:
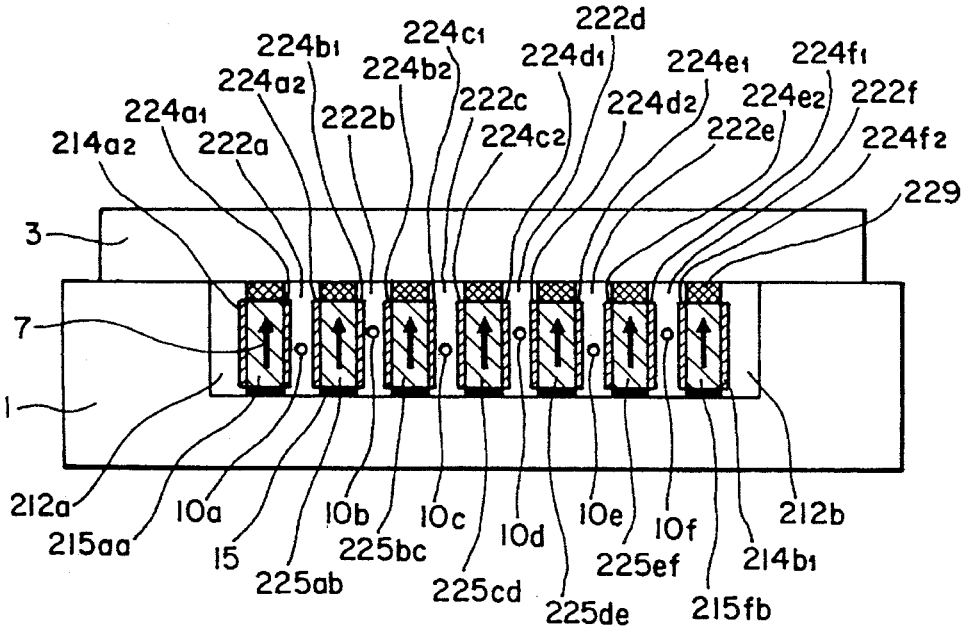
FIG. 22 is a sectional view of Embodiment 3-1 of the present invention.
Figure 37:
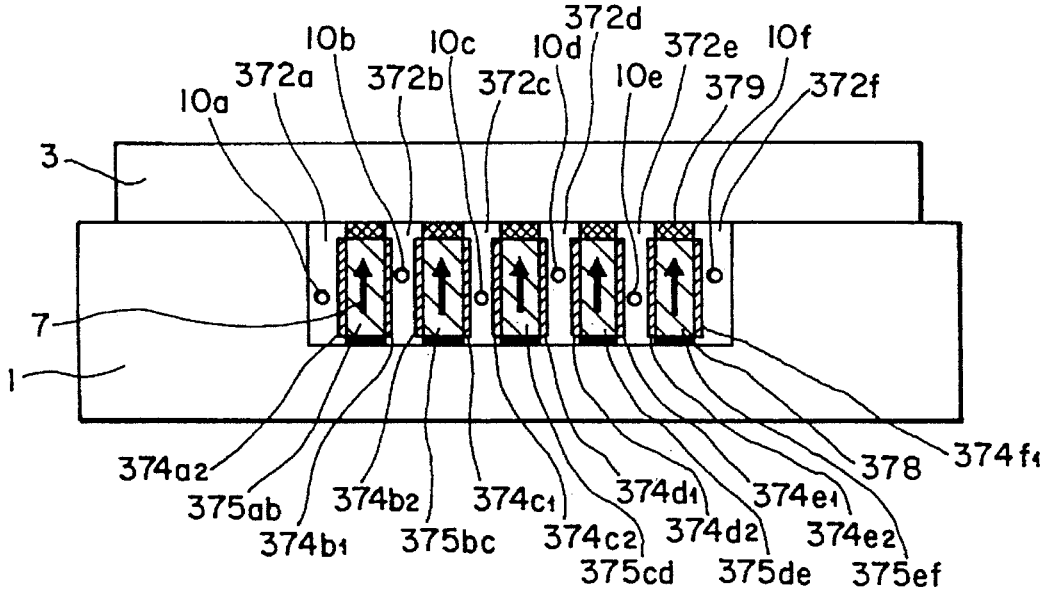
FIG. 37 PRIOR ART
FIG. 37 is a sectional view of the conventional shear mode type ink jet head.

FIG. 22 shows another embodiment, similar to the FIG. 37, of the ink jet head of the present invention. FIG. 22 shows a shear mode type head having six nozzle holes 10*a* to 10*f*. Barriers 225*ab*, 225*bc*, 225*cd* are adhered on an insulating plate 1 by an adhesive layer 15. The barriers are parallel and spaced at equal intervals, and define narrow grooves 222*a* to 222*f*. These grooves are used as an ink chamber and ink channels, and are alternately connected to a common ink reservoir. The barriers are flexibly adhered to the cover, which is made of glass or ceramics, by an elastic material. Electrodes 224*a*2, 224*b*1, 224*b*2, 224*c*1 are formed over the entire walls of the barriers. This construction is essentially the same as that of FIG. 37. However, in the present invention, dummy grooves 212*a*, 212*b* are additionally present. In this embodiment, the dummy barriers 215*aa*, 215*fb*, which are the same as the barriers 225*ab*, 225*ef* in appearance, are formed at both ends and with the same pitch. Also, dummy electrodes 224*a*1, 214*a*2, 224f2, 214*b*1 are formed on the walls of the dummy barriers.

One end of each of the dummy grooves 212*a*, 212*b* connects to the common ink reservoir from which ink is supplied. The other ends of the dummy grooves are sealed. If necessary, a small hole, such as a nozzle hole, may be formed to allow ink to flow easily into the dummy grooves. The shape and size of the small hole may be chosen arbitrarily, so long as the ink does not leak. The arrangement of the nozzle holes 10*a* to 10*f* is restricted as disclosed in Japanese Laid-Open Patent Publication 252750/1988. However, these small holes are not restricted except as to their positions at the end portions of the dummy grooves 212*a*, 212*b*.

In this embodiment, the plate 1 is formed of alumina. Five barriers and two dummy barriers are formed of PZT and are polarized as depicted by the arrows 7. The adhesive layer 15 for adhering the alumina to the PZT is formed of epoxy resin. The groove has a width of 100 μm and a depth of 150 μm. Electrodes and dummy electrodes are laminated on the barrier walls by deposition of chromium and gold. The thickness of the electrodes is 0.8 μm. The lid 3 is an alumina plate and is adhered to the barriers by an elastic material 229 of silicone resin. The nozzle holes are round holes having a diameter 3.5 μm and are formed by etching of the nozzle plate made of stainless steel.

Figure 23:
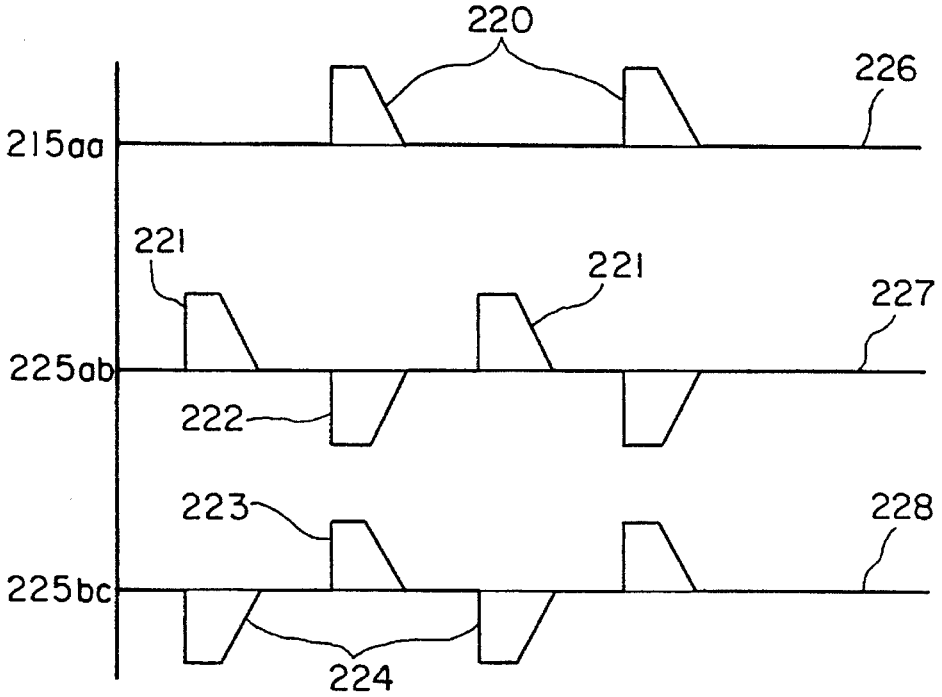
FIG. 23 shows the drive wave form used in Embodiment 3-1.
Figure 38:
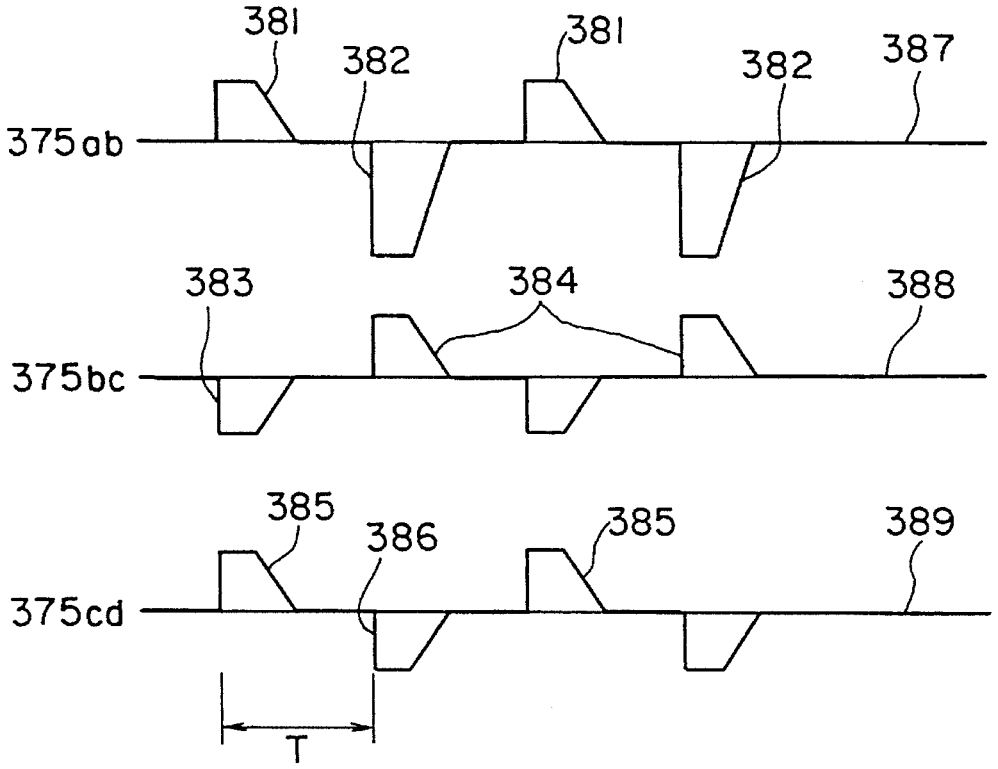
FIG. 38 PRIOR ART
FIG. 38 shows a first drive wave form for the ink jet head of FIGS. 36 and 37.

FIG. 23 shows drive waves. The voltage waves applied to the dummy barrier 215*aa*, and the barriers 225*ab*, 225*bc* are depicted by the straight lines 226, 227, 228, respectively, and each voltage is zero volts. The transverse axis shows the voltage and the ordinate axis shows time. The drive waves are shown as 220, 221, 224. The main difference between this and FIG. 38 which depicts the conventional case is in the wave form for the barrier 375*ab*. In FIG. 23, it is unnecessary to apply voltage of a large absolute value such as 382 of FIG. 38. Rather, it is sufficient to apply a voltage wave 222 the same as the voltage wave 224.

When the voltage wave 220 is applied to the dummy barrier 215*aa*, the change in volume of the groove 222 occurs at the center of the groove 222*b*. It is unnecessary to apply an opposite phase voltage wave to the dummy barrier. The driving power at the two ends of each of the grooves 222*a*, 222*f* is almost the same as that at the center portions thereof. As the driving voltage may be substantially the same for all barriers, the drive stability of the head will not be lost. Therefore, a stable and uniform printing may be provided.

Embodiment 3-2

Figure 24:
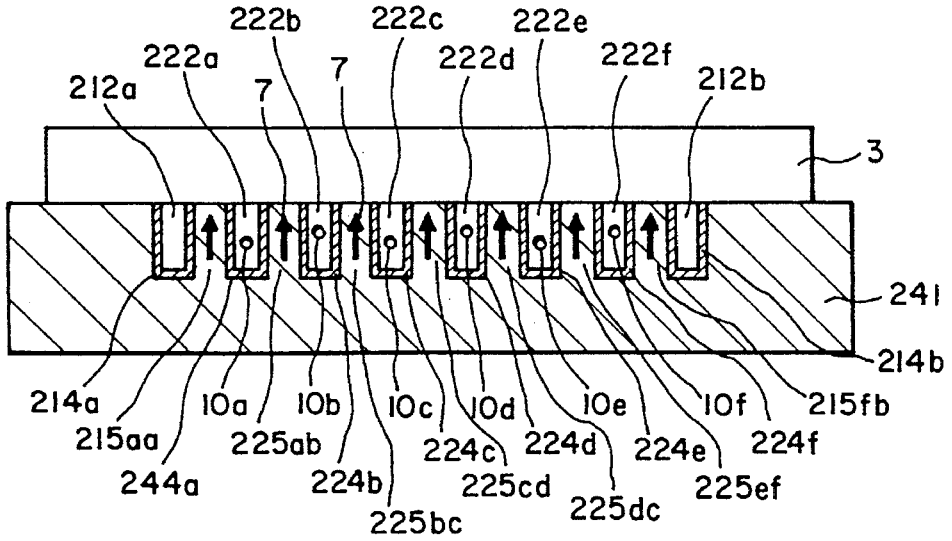
FIGS. 24 to 27 are sectional views of Embodiments 3-2, 3-3, 3-4 and 3-5, respectively, of the present invention.

FIG. 24 shows another embodiment of this invention. In this embodiment, the piezoelectric plate 1, which is an insulating plate, and the barrier 225*ab* of FIG. 22 are formed integrally. The barriers 225*ab* to 225*ef* and the dummy barriers 215*aa*, 215*fb* are polarized in one direction as shown by the arrows 7 as in FIG. 22. The grooves acting as ink chambers and ink channels are 222*a* to 222*f*, and grooves 212*a* and 212*b* are dummy grooves. A lid 3 is provided, and electrodes 244*a*–244*f* are formed on the walls of the barriers. Electrodes 214*a* and 214*b* are dummy electrodes formed on the walls of the dummy barriers.

In the FIG. 22 embodiment, each of the electrodes formed in the grooves is divided in two,, such as, for example, electrodes 224*aa*1, 224*a*2. In the FIG. 24 embodiment, the electrodes 244*a* are not divided. The reason for this is that the electrodes 224*a*1 and 224*a*2 are generally set at same electric potential, in use.

The insulating base plate 1 and the barrier 225*ab* of FIG. 24 are formed integrally. By this integral construction, the stiffness between the plate 1 and the barriers is considerably increased, and the adhesive layer 228 is unnecessary.

Stress arises at the adhesive layers 15 by deformation in the shear mode during driving. The stress cannot be avoided in a high resolution head, for the following reasons. A head having a 300 dpi (dots per inch) resolution, which is the current standard is described as an example. The pitch of the barriers is about 800 μm and the width is about 40 μm. The thickness of the elastic material 9 cannot exceed 10 μm. However, the adhesive layer must maintain insulating characteristics. Also, the process of adhering must be carried out under the Curie temperature (usually under 150° C.) of the piezoelectric material so as to maintain the polarization of the barriers. Therefore, the material for the adhesive layers is restricted to high polymers such as an epoxy resin. However, its thickness is a few micrometers. As the result, following problems occur.

First, the adhesive layers are deformed by the stress caused by the shear mode deformation of the barriers. The deformation of the adhesive layers cannot be avoided. The deformation acts to prevent a decease in the sectional area of the groove 392*b* acting as the ink chamber and ink channel. The ink ejecting power drops by an amount corresponding to the degree of deformation of the adhesive layer 228.

Second, when ink is repeatedly ejected at a high speed, the barrier is vibrated and must have a sufficient stiffness. As the elastic material 229 does not act sufficiently when vibrated, the stiffness of the adhesive layer 15 is affected. However, sufficient stiffness cannot be obtained from a high polymer adhesive agent.

As described above, printing stability and printing speed are reduced because the ink ejecting power and ejecting frequency are reduced.

Embodiment 3-3

Figure 25:
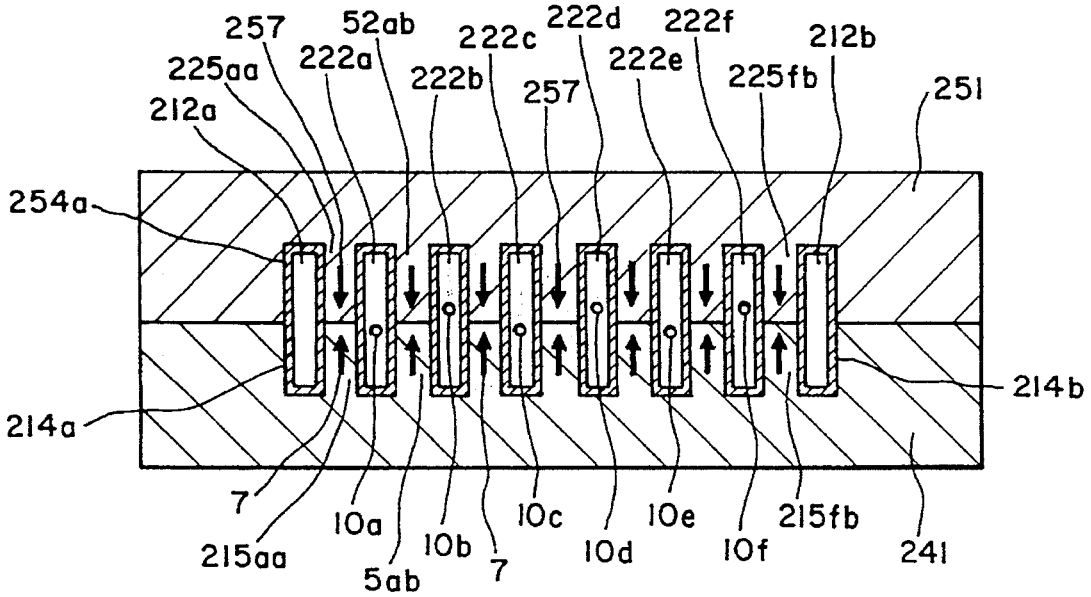

FIG. 25 shows another embodiment of the present invention. The driving principle of the embodiment has been disclosed in Japanese Laid-Open Patent Publication No. 252750/1988.

The construction of the FIG. 25 embodiment corresponds mostly to that of FIG. 24. In this embodiment, a piezoelectric material base plate 251 is used instead of the lid 3 of FIG. 4. Grooves have been formed in the plate 251 as in the plate 241 of FIG. 24. By coupling the two piezoelectric material plates 241, 251, the grooves 222*a* to 222*f* and 212*a*, 212*b* corresponding to the grooves of FIG. 24 are formed. These two piezoelectric material plates are used to increase the drive power for ejecting ink relative to the power in the FIG. 24 embodiment.

The polarization directions of the two piezoelectric materials must be in opposite directions as shown by arrows 7 and 257. Also, the positions of the plates must be as shown in FIG. 25, such that the grooves are aligned.

In the FIG. 25 embodiment, it is important to form the dummy grooves 212*a*, 212*b*. These dummy grooves are formed by grooves of the two piezoelectric plates 241, 251. These plates are adhered to one another.

When the dummy barriers 215*aa*, 225*aa* 215*fb*, 225*fb* are driven by using the electrodes 212*a*, 254*a*, 212*b*, 254*b* on the walls of each of the dummy grooves, the same effect as in the FIG. 24 embodiment may be obtained.

Embodiment 3-4

Figure 26:
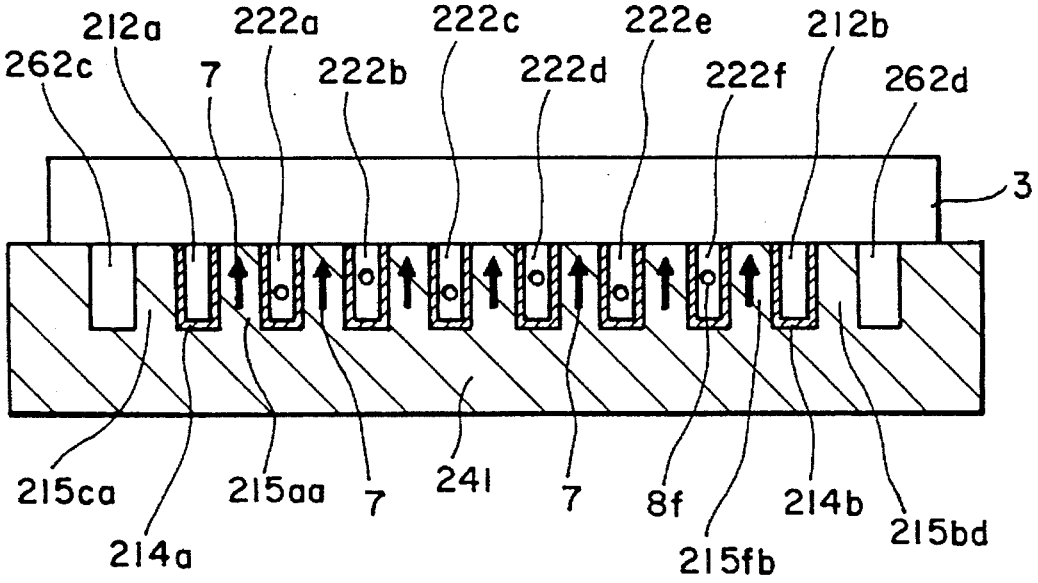

FIG. 26 shows another embodiment of the present invention. In this embodiment, second dummy grooves 262*c*, 262*d* and dummy barriers are formed at the two outermost sides. The outer walls of the dummy grooves 212*a*, 212*b* (on opposite sides of the barriers 215*aa*, 215*fb*) are fixed walls as in the embodiments shown in FIGS. 22, 23 and 25. Therefore, when the grooves are filled with ink, the compliance of the dummy grooves is smaller than that of the other grooves 222*a*, 222*b*. As the outer walls of the dummy barriers 215*aa*, 215*fb* are fixed, during driving, they are stiffer than other barriers 225*ab*, 225*bc*. As the result, the uniformity of ink ejecting performance is lost.

The present embodiment is intended to overcome this problem. Therefore, the second dummy grooves act only as mechanical buffer. It is unnecessary to form the electrodes in the grooves, and it is unnecessary to polarize the outer dummy barriers 215*ca*, 215*bd*.

Even if the electrodes are present, and even if they are polarized during manufacturing process, such does not cause a problem. It also does not matter whether or not small hole is formed at the nozzle plate. It is also possible to form more than two dummy grooves on each side.

Embodiment 3-5

Figure 27:
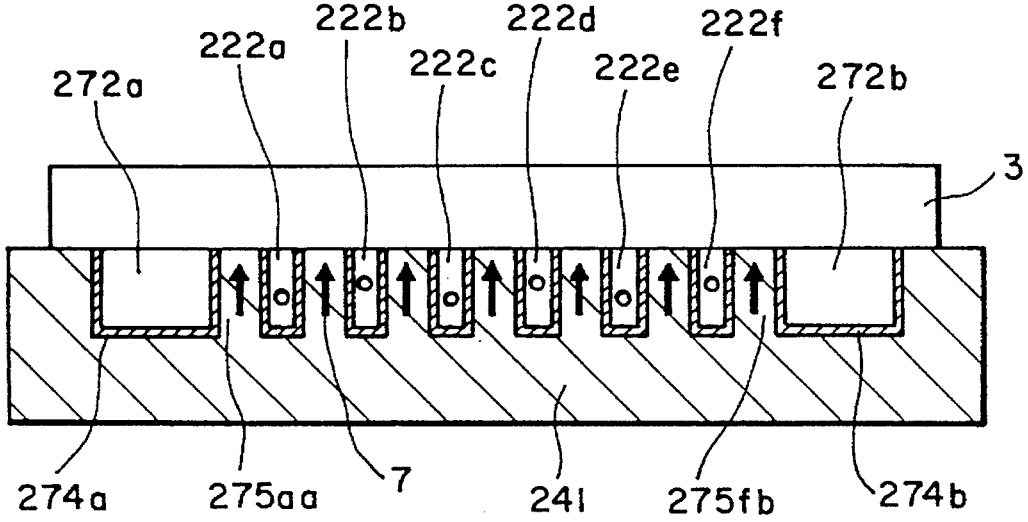

FIG. 27 shows another embodiment of the present invention, having the same effects as the FIG. 26 embodiment. Instead of the second dummy grooves, the dummy grooves 272*a*, 272*b* having larger sectional area than the barriers 222*a*, 222*b* are formed. These dummy grooves 272*a*, 272*b* can correct a reduction in compliance of the dummy grooves used in the FIG. 22 and FIG. 24 embodiments.

The sectional area may be enlarged by increasing the width of the grooves or increasing the depth of the grooves. Dummy electrodes 274*a*, 272*b* can be formed in the grooves, in order to obviate the problems of non-uniformity of ink ejection between the ends and the nozzle holes at the center portions, which is a serious problem in the shear mode type ink jet heads. Therefore, the printing quality may be greatly improved.

Embodiment 4-1

Figure 28:
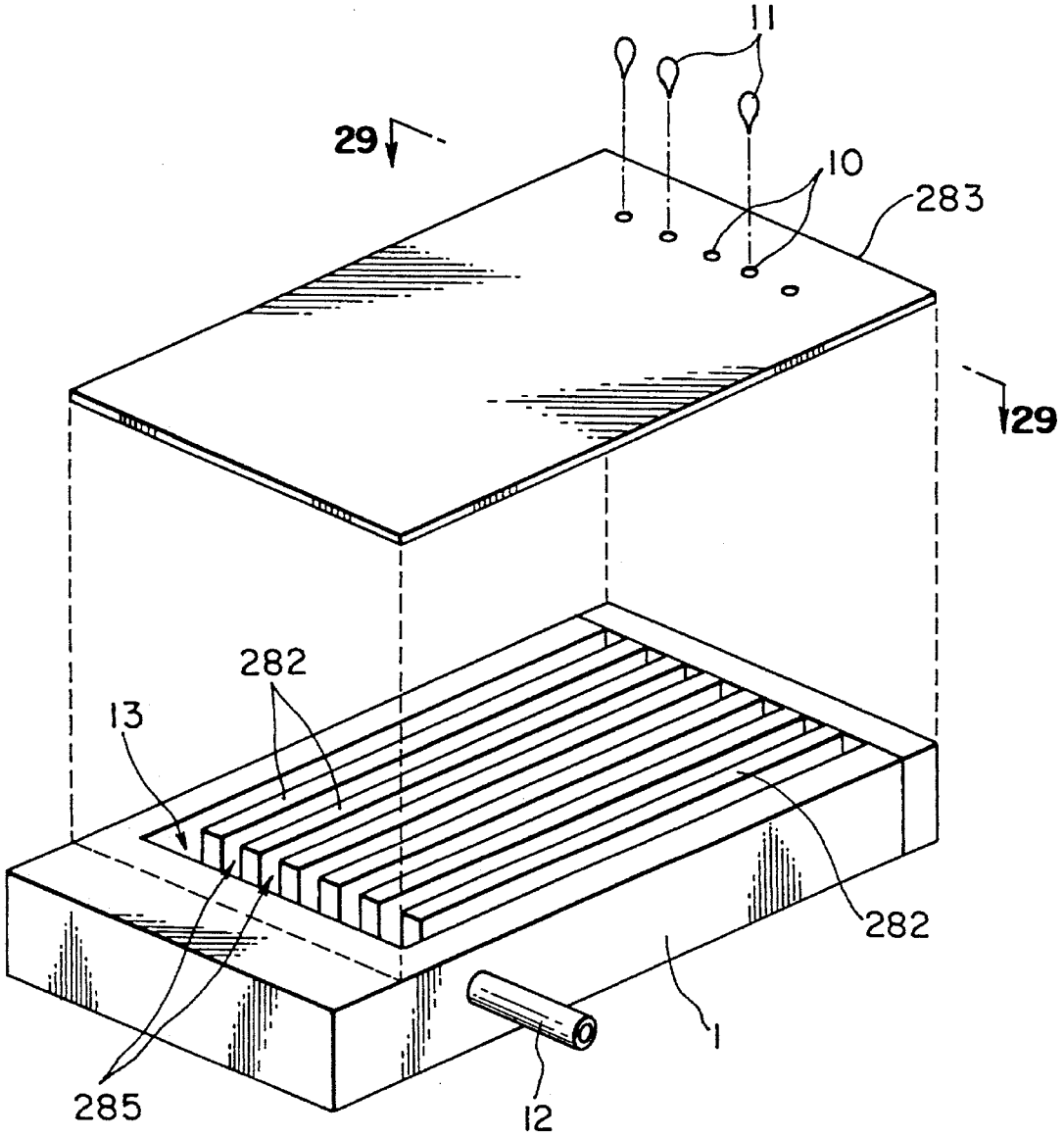
FIG. 28 is a perspective view of Embodiment 4-1 of the present invention.
Figure 41:
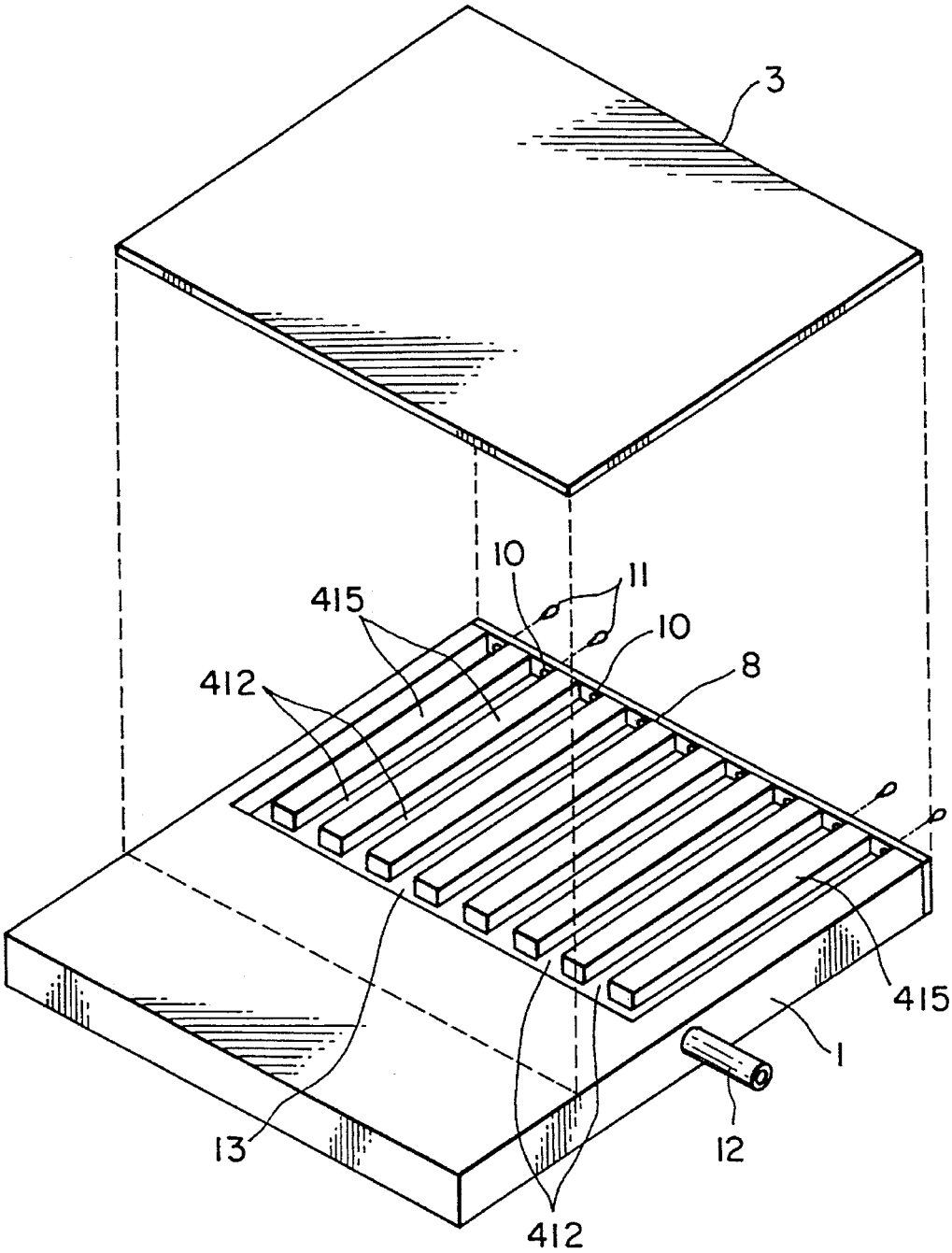
FIG. 41 PRIOR ART
FIG. 41 is a perspective view of the conventional shear mode type ink jet head.

FIG. 28 shows an ink jet head of the present invention similar to the conventional head of FIG. 41.

The barriers 282 of the piezoelectric material are adhered on the insulating base plate 1 in parallel and at equal intervals so as to form narrow grooves 285 which are used as ink chambers and ink channels. First ends of these grooves connect to the common ink reservoir 13 and second ends are sealed by a side plate 14. In this embodiment, the upper plate 283 having nozzle holes 10 is fixed to cover the grooves 285 and the ink reservoir 13. This upper plate 283 may be formed in two parts, one of which includes nozzle holes. The ink is introduced from the ink supply tube 12 and is supplied to each groove 285 through the ink reservoir 13. When the barriers 282 are driven, as described with reference to FIG. 39, the ink is ejected as ink droplets.

Figure 29:
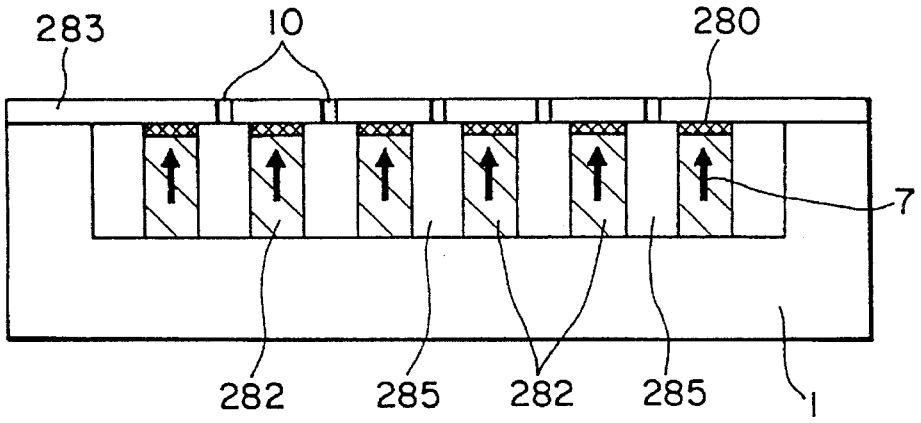
FIG. 29 is a sectional view of Embodiment 4-1.
Figure 39:
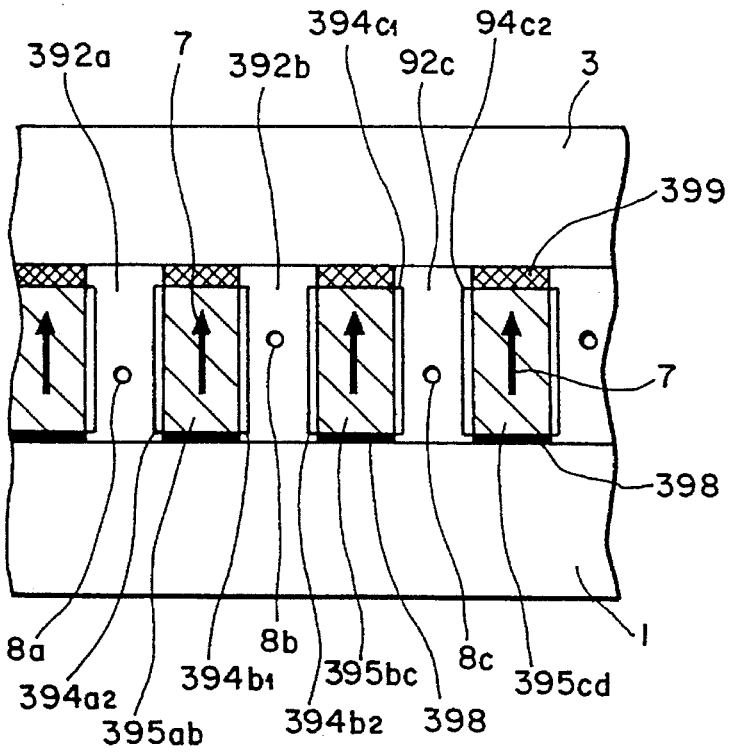
FIG. 39 PRIOR ART
FIGS. 39 and 40 are sectional views of a conventional shear mode type ink jet head.
Figure 40:
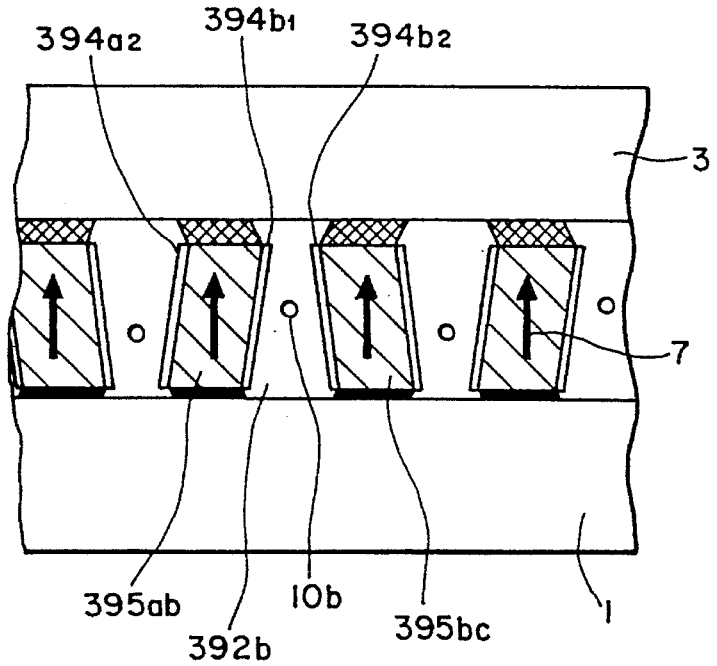
FIG. 40 PRIOR ART

FIG. 29 is a sectional view taken along line 29—29 of FIG. 28. The barriers 282 of the piezoelectric material are polarized in one direction as shown by the arrows 7. The elastic material 280 is adhered between the barriers 282 and the upper plate 283. The barriers and upper plate may be fixed without using the elastic material. The nozzle holes 10 is positioned at the centers of the narrow grooves 285 which act as ink chambers and ink channels. The electrodes shown in FIG. 39 are omitted in FIG. 29.

In this embodiment, a side plate 14, instead of a nozzle plate as in the conventional embodiment, is fixed to the ends of the narrow grooves 285. As this side wall 14 is used only for sealing, precision fitting is not required. If, for example, the end portion of the barrier 282 facing the side wall 14 has been broken, the broken part may be joined with the side wall by the adhesive agent. If the whole of the ends of the grooves are filed by the adhesive agent, the side wall 14 becomes useless.

In the conventional embodiment, it is difficult to make such repair for the following reasons. The nozzle plate is fixed to the end portions of the barriers having a width under about 100 μm. The nozzle holes having a diameter of 30 μm are formed in the nozzle plate. If the end portion is broken, it is very hard to repair the broken portion without affecting the nozzle holes. If adjacent grooves become connected due to breaking of the barrier adjacent to a nozzle hole, the ink pressure in the groove adjacent the nozzle hole becomes unstable, thereby affecting the ejecting efficiency. Therefore, ink ejecting speed and volume become unstable.

In the present embodiment, the barriers 282 are formed PZT, have a width of 100 μm and a height of 150 μm, and are polarized as shown by the arrows 7. These barriers are adhered to the alumina plate 1 at a pitch of 200 μm by epoxy resin. On the side walls of the barriers, the electrode is formed by laminating chromium and gold by deposition to a thickness of 8 μm. The plastic upper plate 283 having nozzle holes of a diameter of 35 μm is adhered to the barriers by the elastic material 280 of silicone resin.

Embodiment 4-2

Figure 30:
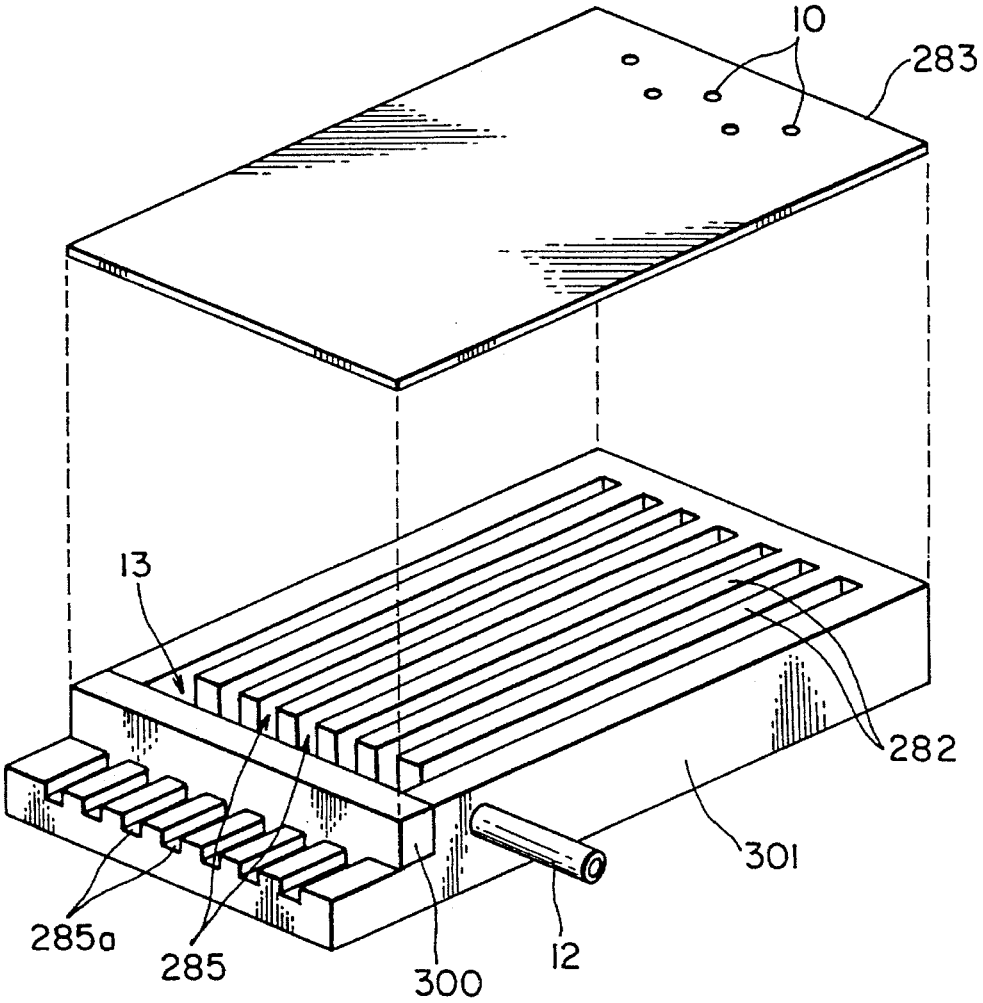
FIG. 30 is a perspective view of Embodiment 4-2 of the present invention.

FIG. 30 shows another embodiment of the present invention. A piezoelectric material plate 301 similar to the insulating plate 1 and barriers 282 are formed integrally as in the FIG. 28 embodiment. As the barriers 282 must be polarized in one direction as in the FIG. 24 embodiment, this whole plate 301 is polarized.

The grooves 285, which act as ink chambers and ink channels, are formed by cutting the plate 301 with a dicing saw. The grooves are formed by repeatedly cutting from one end of the piezoelectric material plate to the other end. One end is cut to a point near the end so as to form a side wall 14 as in FIG. 28. A step is formed on the other end and is provided with shallow grooves 285*a*. Electrodes are formed in the shallow grooves 285*a* to connect with outer electrodes. These electrodes connect with the electrodes of the barriers 282. The sealing plate 300 is fixed to the side of the step to prevent escape of the ink. The arrangement of the nozzles 10 is different than in FIG. 28. This arrangement may be selected as desired, depending on the drive and fixing of the head.

Embodiment 4-3

Figure 31:
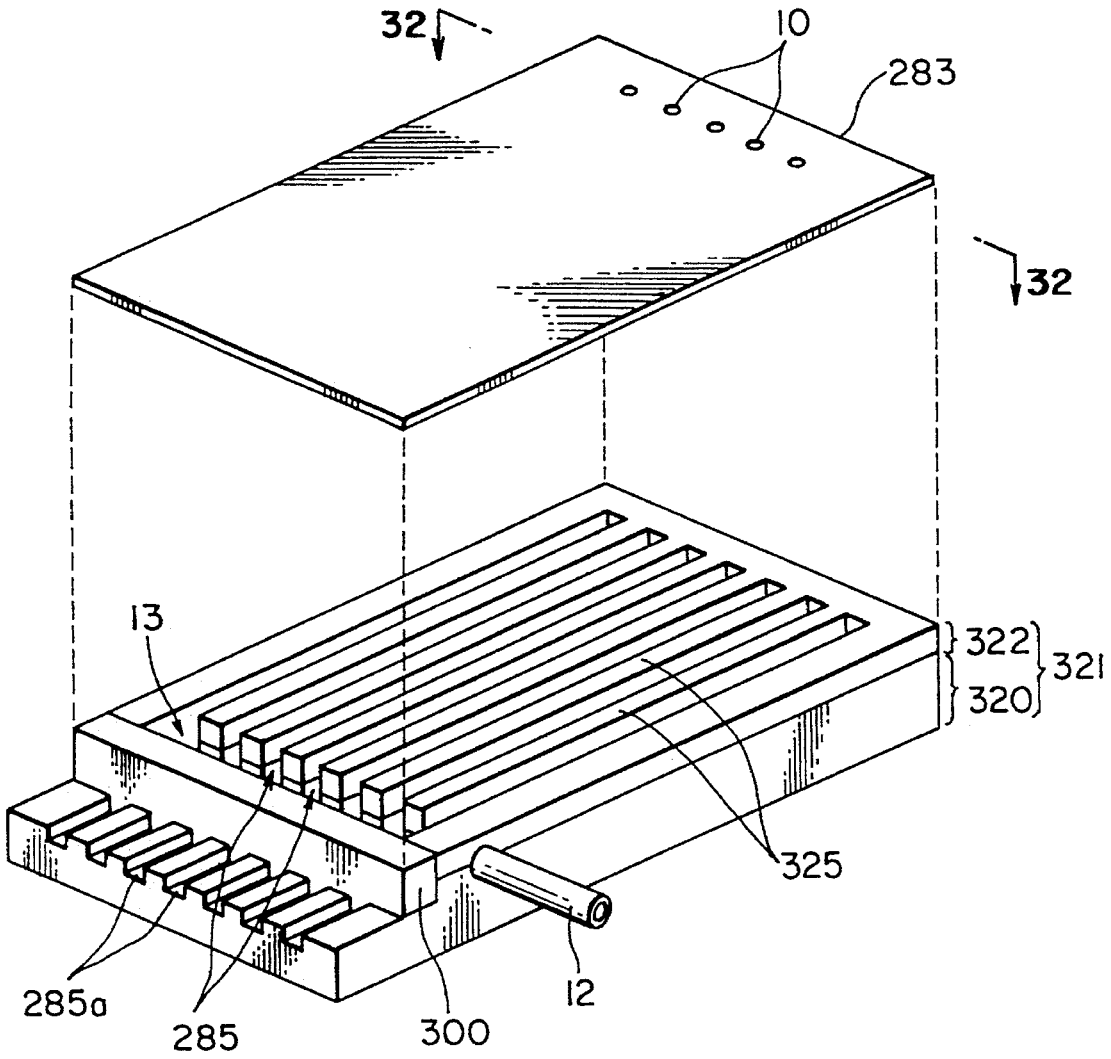
FIGS. 31 and 32 are perspective and sectional view of Embodiment 4-3 of the present invention.

FIG. 31 shows an embodiment of the present invention utilizing same driving principle as disclosed in FIG. 2 of Japanese Laid-Open Patent Publication No. 252750/1988.

Figure 32:
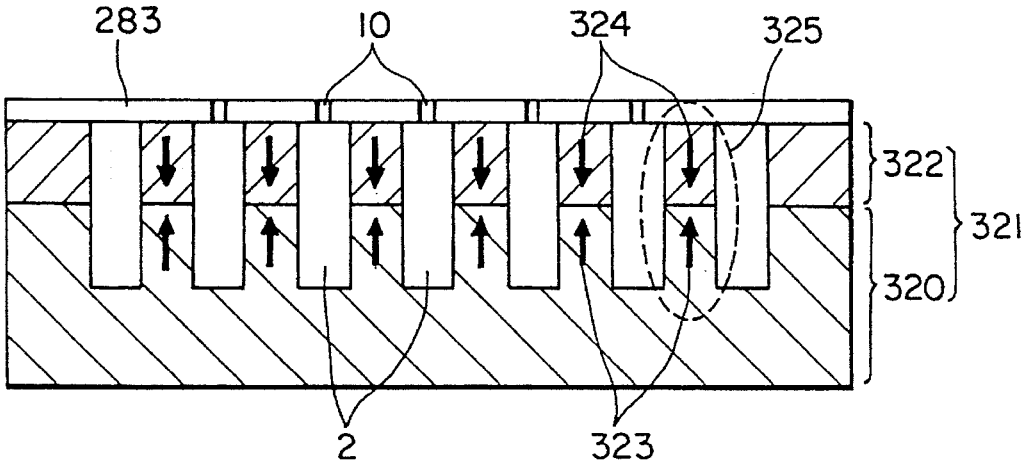

FIG. 32 is a sectional view taken along line 32—32 of FIG. 31. The main structure is the same as shown in FIG. 30, but the base plate 301 of piezoelectric material of FIG. 30 is replaced with a base plate 321 which is an integral combination of two piezoelectric material members 320 and 322. The polarization directions 323, 324 are mutually opposite. In this case, the barriers 325 deform in a bow shape, which is different from the FIG. 30 embodiment. The arrangement of the nozzle holes is as previously stated.

Embodiment 4-4

Figure 33:
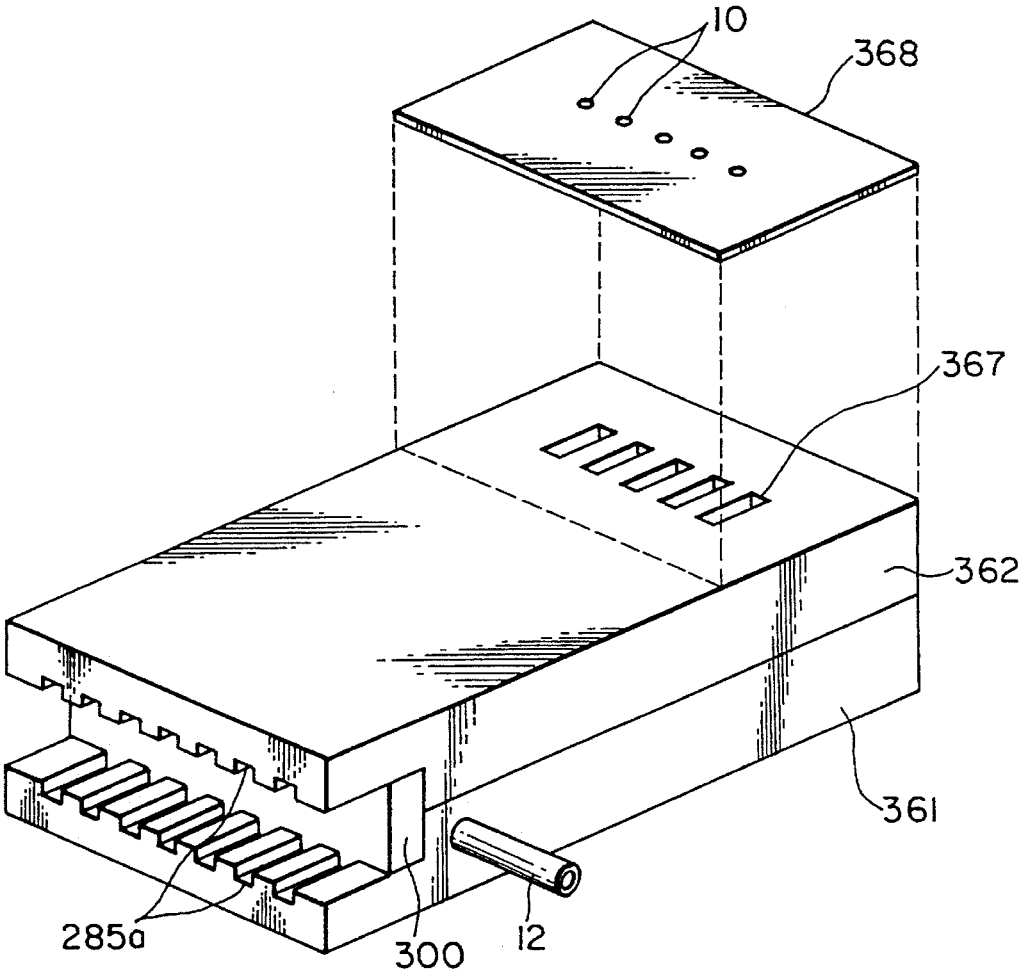
FIG. 33 is a perspective view of Embodiment 4-4 of the present invention.

FIG. 33 shows another embodiment of the present invention. In this embodiment, the two piezoelectric material members 322, 320 of FIG. 31 are divided into two base plates 361, 362. Therefore, the structures of these base plates 361 and 362 correspond to those of the base plate 301 of FIG. 30. The combined base plates 362, 361 is polarized in mutually opposite directions as in the FIG. 32 embodiment so as to obtain a driving as in the FIG. 31 embodiment. Guide holes 367 are formed in the plate 362 and are aligned with the nozzle holes 10 of the nozzle plates 368.

Embodiment 4-5

Figure 34:
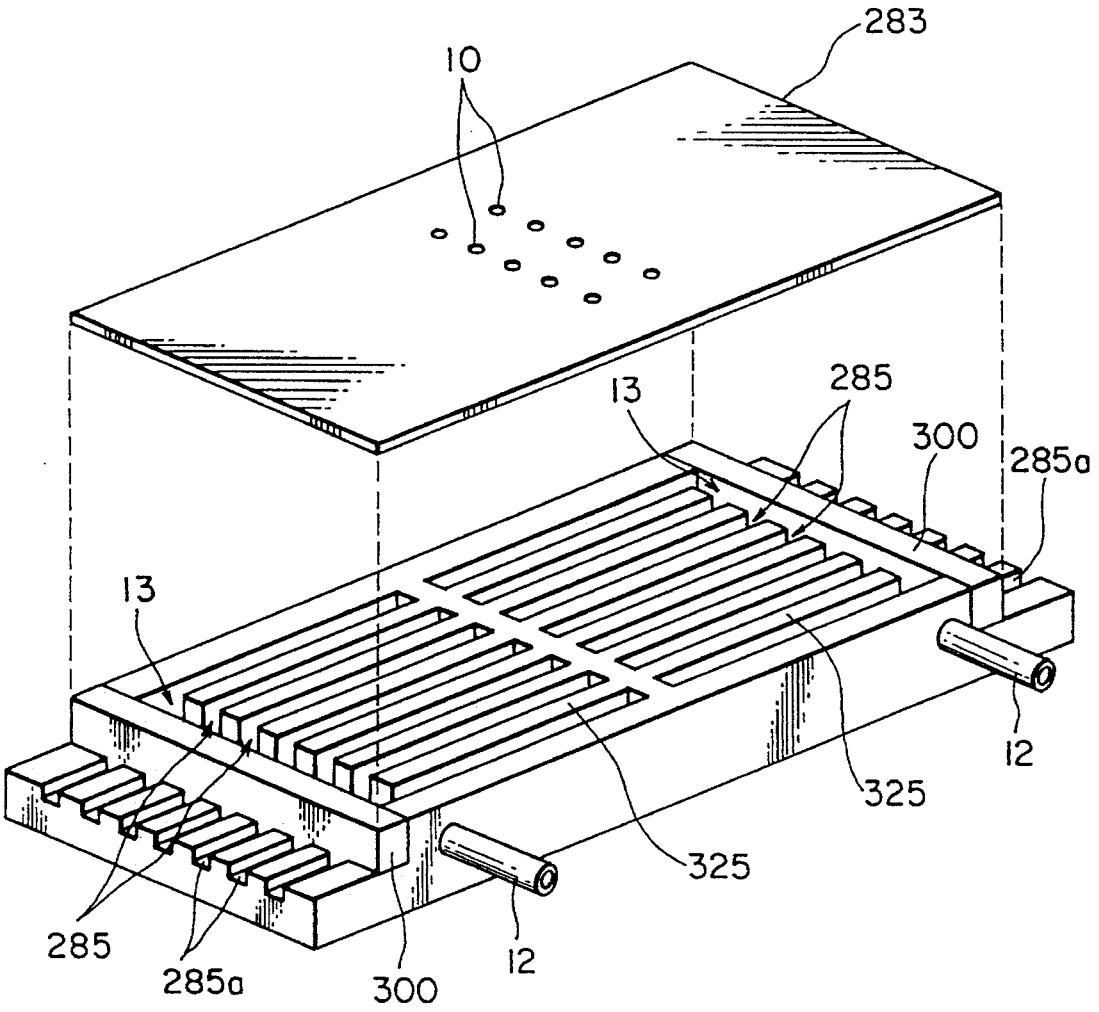
FIG. 34 is a perspective view of Embodiment 4-5 of the present invention.

FIG. 34 shows another embodiment which is a combination of two of the heads of the FIG. 30 embodiment. With the FIG. 34 arrangement, it is possible to obtain twice the printing density, because two parallel lines of nozzle holes, having the same pitch as in FIG. 30 are present. This effect may be obtained merely by providing the arrangement of the nozzle holes as the present invention. The grooves may thereby be utilized efficiently. The barriers on one side should be moved by half a pitch relative to the barriers on the other side, to be effective.

We claim:

1. An ink jet head comprising:

a plurality of elongated members formed of piezoelectric material, said elongated members being spaced apart from one another so as to define therebetween a plurality of elongated channels, alternating ones of said elongated channels defining ink channels;

electrodes formed in said channels on opposing sides of said elongated members;

a channel closing member mounted to said elongated members to cover portions of said channels, said channel closing member having nozzle holes respectively formed therein in alignment with at least some of said channels;

wherein said elongated members are polarized in at least one transverse direction across said elongated members and said channels;

wherein said elongated members and said electrodes comprise an ink jetting means for selectively jetting ink from said nozzle holes by selectively changing volumes of said ink channels by expansion mode deformation of selected ones of said elongated members, upon application of a drive voltage, having a polarity corresponding to a direction of polarization of said elongated members, to selected ones of said electrodes.

2. An ink jet head as recited in claim 1, further comprising a base member formed of piezoelectric material, said elongated members being mounted on said base member.

3. An ink jet head as recited in claim 1, wherein said at least one transverse direction in which said elongated members are polarized is limited to a single transverse direction.

4. An ink jet head as recited in claim 1, wherein said at least one transverse direction in which said elongated members are polarized comprises opposing transverse directions, such that the polarization direction of each of said elongated members is opposite to the polarization direction of each of said elongated members adjacent thereto.

5. An ink jet head as recited in claim 4, wherein in each of said channels which has two of said electrodes facing one another, said two of said electrodes are connected electrically.

6. An ink jet head as recited in claim 1, wherein said nozzle holes are respectively disposed at longitudinal ends of said elongated ink channels, such that said ink jetting means is operable to eject ink from said holes in a longitudinal direction of said channels.

7. An ink jet head as recited in claim 1, wherein each of said nozzle holes, in cooperation with said ink jetting means, comprises a means for ejecting ink in a direction normal to a longitudinal direction of said channels.

8. A drop-on-demand ink jet head comprising:

a base member formed of piezoelectric material;

a plurality of elongated members formed of piezoelectric material and being mounted on said base member, said elongated members being spaced apart from one another so as to define therebetween a plurality of elongated channels, first alternating ones of said elongated channels defining ink channels, and second alternating ones of said elongated channels constituting dummy channels disposed between said ink channels;

electrodes formed in said channels on opposing sides of said elongated members;

a lid mounted to said elongated members and covering said channels;

a covering member mounted to the base member and closing said channels;

wherein nozzle holes are formed in one of said lid and said covering member in alignment with at least some of said channels, respectively;

wherein said base member includes a base portion disposed on a side of said elongated members opposite said lid;

wherein said elongated members are polarized in at least one transverse direction across said elongated members and said channels;

wherein said elongated members and said electrodes comprise an ink jetting means for selectively jetting ink from said nozzle holes by selectively changing volumes of said ink channels by expansion mode deformation of selected ones of said elongated members, upon application of a drive voltage, having a polarity corresponding to a direction of polarization of said elongated members, to selected ones of said electrodes.

9. A drop-on-demand ink jet head as recited in claim 8, wherein said at least one transverse direction in which said elongated members are polarized is limited to a single transverse direction.

10. A drop-on-demand ink jet head as recited in claim 8, wherein said at least one transverse direction in which said elongated members are polarized comprises opposing transverse directions, such that the polarization direction of each of said elongated members is opposite to the polarization direction of each of said elongated members adjacent thereto.

11. A drop-on-demand ink jet head as recited in claim 8, wherein said elongated members are integral portions of said base member.

12. A drop-on-demand ink jet head as recited in claim 8, wherein said nozzle holes are respectively disposed at longitudinal ends of said elongated ink channels, such that said ink jetting means is operable to eject ink from said holes in a longitudinal direction of said channels.

13. A drop-on-demand ink jet head as recited in claim 8, wherein each of said nozzle holes, in cooperation with said ink jetting means, comprises a means for ejecting ink in a direction normal to a longitudinal direction of said channels.

14. A drop-on-demand ink jet head as recited in claim 8, wherein each of said dummy channels is filled with an elastic material.

15. A drop-on-demand ink jet head as recited in claim 8, wherein said nozzle holes are formed in said lid; and each of said nozzle holes is aligned with a respective one of said ink channels near a longitudinal center thereof.

16. A drop-on-demand ink jet head as recited in claim 15, wherein said nozzles are spaced apart from one another at equal intervals along the longitudinal direction.

17. An ink jet head as recited in claim 4, wherein in each of said channels which has two of said electrodes facing one another, said two of said electrodes are connected electrically.

18. A drop-on-demand ink jet head as recited in claim 1, wherein each of said dummy channels is filled with an elastic material.

19. A drop-on-demand ink jet head as recited in claim 8, wherein said base portion of said base member is polarized in a direction toward said elongated members and said channels and perpendicular to the at least one transverse direction of polarization of said elongated members.

* * * * *